US005441063A

United States Patent [19]

Fernandez et al.

[11] Patent Number: 5,441,063

[45] Date of Patent: Aug. 15, 1995

[54] HIGH SPEED BOTTLE WASHING MACHINE

[75] Inventors: Antonio Fernandez, Danbury, Conn.; Attila Soti, Mississauga, Canada; Steve Miller, Vienna, Austria

[73] Assignee: PepsiCo, Inc., Purchase, N.Y.

[21] Appl. No.: 90,503

[22] Filed: Jul. 13, 1993

[51] Int. Cl.[6] ..... B08B 9/08

[52] U.S. Cl. ..... 134/142; 134/144; 134/157; 134/153; 134/181; 134/167 R; 134/172; 134/66; 134/62

[58] Field of Search ..... 134/66, 167 R, 172, 134/181, 153, 158, 157, 144, 152, 142, 113, 58 R, 57 R, 62

[56] References Cited

U.S. PATENT DOCUMENTS

| | | | |
|---|---|---|---|
| 721,824 | 3/1903 | Norkewitz | 134/144 |
| 813,144 | 2/1906 | Loen | 134/144 X |
| 908,446 | 1/1909 | Court | 134/144 |
| 934,870 | 9/1909 | Wolfensberger | 134/167 R X |
| 1,055,220 | 3/1913 | Pindstofte | 134/152 X |
| 1,598,175 | 8/1926 | Taylor | 134/167 R |
| 3,240,216 | 3/1966 | Sadwith | 134/152 X |
| 3,563,256 | 2/1971 | Babunovic | 134/144 |
| 3,614,958 | 10/1971 | Perrier | 134/152 X |
| 4,051,805 | 10/1977 | Waldrum | 134/152 X |
| 4,509,543 | 4/1985 | Livingston | 134/113 X |
| 4,683,009 | 7/1987 | Shriver | 134/66 X |
| 4,803,055 | 2/1989 | Ueda | 134/62 X |

FOREIGN PATENT DOCUMENTS

| | | | |
|---|---|---|---|
| 71886 | 2/1960 | France | 134/144 |
| 1457007 | 4/1969 | Germany | 134/167 R |

*Primary Examiner*—Frankie L. Stinson
*Attorney, Agent, or Firm*—Scully, Scott, Murphy & Presser

[57] ABSTRACT

A high-speed bottle washing machine provides concurrent rotational motion to a workpiece as it is conveyed through a washing treatment zone for internal and external spray treatments. The machine comprises a plurality of moving bottle receiving stations for sequentially receiving and rotating inverted bottles received from a bottle infeed conveyor, a plurality of reciprocating spray nozzles, with at least one spray nozzle moving with each bottle receiving station, wherein each of the spray nozzles reciprocates from a first position below the inverted bottles, to a second position within the bottles, and a manifold assembly for sequentially supplying a caustic wash fluid under pressure to each of the plurality of spray nozzles to clean the bottles by impingement of the wash fluid in a predetermined pattern within the bottles as the bottles are rotated. The washed bottles are finally discharged at a bottle outfeed conveyor.

58 Claims, 18 Drawing Sheets

PLANT AIR IN
383
PLC
300

STAR WHEEL 1
VSS-1
STAR WHEEL 2
VSS-2
MAIN VACUUM VP-0102
7.5 HP
377
VSS-3
STAR WHEEL 3
374
378
FROM FIG. 3C

TO BOTTOM DISTIBUTORS & TIMING SCREWS
TO MAIN VACUUM PUMP SEAL WATER
375
TREATED WATER
1/2

ROTATION DRIVE
0.5 HP
193a
193b
193c
193d
193e
194a
194b
194c
194d
194e
195
197
OUTFEED DRIVE
198
192
INEED DRIVE
196
191
CAROUSEL DRIVE
30 HP
199
190

HIGH SPEED BOTTLE WASHING MACHINE

BACKGROUND OF THE INVENTION

1. Field of the Invention

The present invention relates generally to automatic high-speed bottle washer and spraying systems and more particularly to an automatic high-speed bottle washing machine for washing and sanitizing plastic returnable bottles (PRB).

2. Discussion of the Prior Art

The manufacture of returnable and refillable bottles has become widespread in both the glass and plastic bottling industries. Many countries have mandated their use in an effort to conserve energy and to keep raw material consumption to a minimum. Furthermore, commercially viable, refillable bottles and containers not only conserve energy, but help to reduce land-fill and recycling problems usually associated with disposable type plastic and glass bottles and containers. One industry in particular where the desirability of utilizing plastic reusable and refillable bottles (PRB's) is increasing, is in the soft drink beverage industry.

To be commercially viable as a refillable bottle for soft drink beverages, the PRB must retain its aesthetic and functional qualities over a minimum of ten and preferably over twenty cycles or "trips" in its lifetime. A typical cycle that a returnable/refillable plastic bottle goes through has been described in numerous patents and technical articles. For instance, U.S. Pat. No. No. 4,725,464 to Collette, describes a cycle as comprising: 1) an empty caustic wash followed by 2) contaminant inspection and product filling/capping, 3) warehouse storage, 4) distribution to wholesale and retail locations, and 5) purchase, use, and empty storage by the consumer followed by eventual return to the bottler. Presently, plastic beverage bottles made of polyesters, such as polyethylene terephthalate (PET) and copolymers thereof, acrylonitrile, and polycarbonate have the requisite physical and aesthetic qualities most desirable for producing refillable plastic containers. As is well known in the art, PET offers the best balance of properties and, cost and performance ratios.

While the plastic bottling industry has made great strides in obviating the problems associated with cleaning and washing of the PRBs during a typical cycle, problems still exist with currently existing bottle washing machines. For instance, many of the existing machines for washing plastic returnable bottle (PRB) include one or more pre-treatment steps before carrying out an internal and/or external spray treatment. One such washing machine described in U.S. Pat. No. 4,154,624 provides for the pre-treating of the PRB by soaking each bottle in a water pre-softening bath or caustic solution pre-softening bath. The goal of pre-treating each bottle is to remove coarse soils and residues from the beverages or products. Often these pre-softening steps are time-consuming and reduce the throughput desirable in high-output automatic PRB washing machines. In addition, the pre-softening treatment with high-temperature baths may cause premature shrinkage of the PRB, or induce stress crack failure in non-oriented portions of the bottle.

After pretreating, the PRB's are usually conveyed to an in-line or rotary carrier where they are held in place and subject to additional various external and internal spraying by additional detergents, air, and water. U.S. Pat. No. 4,125,120 discloses an inline conveyor system for washing light weight plastic bottles with a plurality of insertable spray wands. A conveyor advances in a stepwise manner and an entire manifold of nozzles is elevated by a pair of hydraulic cylinders attached to lift bars. U.S. Pat. No. 4,080,974 discloses an inline conveyor having a plurality of bottle carriers which receive the bottles in an inverted position and which are equipped with a plurality of moving spray nozzles which accompany, but which are not inserted in the bottle, along a portion of its travel for spraying and rinsing.

U.S. Pat. No. 3,226,757 and European Patents 0 265,343 and 2 607,127 disclose a bottle cleaning machine which uses a mechanism for inverting the bottles for placement into a plurality of bottle carriers and insertable wands for blowing or rinsing the bottles. U.S. Pat. No. 5,135,014 discloses a bottle washer with multiple size carriers having a sorting mechanism, a device for inverting the bottles, an inline carrier having a plurality of bottle carriers with a holddown means for adjusting the carrier to various sized bottles, and interior and exterior spray nozzles for cleaning the interior and exterior of the bottles. A spray nozzle is inserted inside the bottle, although it does not move with the bottle. The conveyor is advanced step wise on an intermittent basis and a plurality of nozzles are inserted into the bottles at each step. U.S. Pat. No. 3,534,749 discloses a rotating turntable having a plurality of bottle holding stations which are positioned above the spray nozzles. As the containers are rotated inside the spray cabinet, they are subject to both interior and exterior sprays for cleaning.

One problem associated with current soaking and spray washing machines is that many bottles are subject to stress crack failure by reason of the combination of the high temperature wash solution, the caustic nature of the solution, and the way they are handled. Other automated bottle washing systems provide mechanisms for handling containers, for example, by cradle (U.S. Pat. No. 4,080,974), or by basket (U.S. Pat. No. 4,154,624), as the bottles are being conveyed or transferred through the wash treatment. Both scuffing and stress crack failure occur in these mechanisms as the bottles rub or brush against each other or against the holders or cages in which they are transported.

Other prior art bottle washing machines which provides for the rotation of the bottles as they are being cleaned include U.S. Pat. No. 4,461,054 which discloses a device for rotating and cleaning containers with particulate matter by inserting a spray nozzle into bottles as they are rotated. During the cleaning operation the bottles are reciprocated downwardly into the containers for the cleaning step. Similarly, U.S. Pat. No. 4,133,340 discloses a rotating turntable for rotating a workpiece which is cleaned on the inside with spray nozzle having a plurality of orifices of and on the outside by spray nozzles placed on wands. In both of these references there is no movement of the rotating bottle.

Several other types of bottle washing systems use vertical carousels that are adapted to be connected to inline conveyors. U.S. Pat. Nos. 4,944,810 and 4,834,123 disclose vertical carousels having paddles which engage the lower portion of the bottle and urge it inwardly over a spray nozzle for cleaning. U.S. Pat. No. 3,302,655 discloses a similar concept without the nozzle penetration, but including exterior washing of the bottle with nozzles.

In view of the above-mentioned limitations and disadvantages of the bottle handling devices found in current automated bottle washers, there is accordingly a need to provide an apparatus for holding and rotating bottles or containers in a manner that minimizes the thermal stress in the neck areas and scuffing of the shoulder base regions and that does not require any sort of retaining or locking means.

Furthermore, it would be highly desirable for a high-speed bottle washing machine to provide for a spray nozzle that discharges fluid jets in a predetermined pattern such that when in combination with a rotating bottle, hard to reach soils accumulated at the bottom of a bottle can be effectively cleaned in shorter periods of time. Moreover, it would be highly desirable to provide for a high-speed bottle washing machine with moving bottle carriers and wash nozzles which are inserted as the bottle is rotated and moved and furthermore, one that performs the process of washing a PET bottle in a 20 second cycle with aggressive mechanical impingement of a caustic wash solution.

SUMMARY OF THE INVENTION

Accordingly, an object of the present invention is to provide for a high-speed bottle washing machine that utilizes in-line handling and positive control of the bottles in a rotary washer which will wash at higher speeds by the use of spray impingement in which specially designed spray nozzles are inserted into rotating bottles to clean in a fraction of the time required by prior art devices.

To this end, another object of the instant invention is to provide a high speed bottle washing machine that includes a bottle handling apparatus that can provide axial rotational motion to the bottle such that, when its interior is subject to a cleaning fluid spray from a specially configured spray nozzle, a more precise and effective chemical and mechanical cleaning of the interior of the bottle is accomplished.

Yet still another object of the instant invention is to provide a high-speed plastic returnable bottle washing machine which provides for improved plastic returnable bottle life by reducing scuffing, reducing stress cracking, reducing shrinkage, and reducing contact time with high temperature washing detergents. The washing machine improves plastic returnable bottle operating efficiency by increasing the average number of returns for each bottle, and enabling operation with different size bottles.

Additionally, an object of the present invention is to provide a high-speed bottle washing machine that reduces costs associated with washing by improving line efficiency, reducing floor area, chemical costs, and utility costs.

In accordance with the teachings herein, the present invention provides for a high-speed bottle washing machine that comprises a plurality of moving bottle receiving stations for sequentially receiving and rotating inverted bottles received from a bottle infeed conveyor, a plurality of reciprocating spray nozzles, with at least one spray nozzle moving with each bottle receiving station, wherein each of the spray nozzles reciprocates from a first position below the inverted bottles, to a second position within the bottles, and a manifold assembly for sequentially supplying a caustic wash fluid under pressure to each of the plurality of spray nozzles to clean the bottles by impingement of the wash fluid in a predetermined pattern within the bottles as the bottles are rotated. The washed bottles are finally discharged at a bottle outfeed conveyor.

Still another object of this invention is to provide for a bottle holding and rotating device that engages an invertedly positioned plastic returnable bottle in a manner so as to provide support at three points of contact, while simultaneously providing bottle rotation.

Yet still another object of this invention is to provide a high speed bottler washing machine that includes a specially designed spray nozzle assembly for cleaning the interior of each bottle and which discharges jets of fluids in a unique pattern, such that in combination with the rotation of the bottle, effective cleaning by a combination of chemical dissolution and mechanical impingement is accomplished. To this end, another object of this invention is to provide a nozzle spray and orifice assembly that discharges jets of pressurized cleaning fluid within the rotatable invertedly positioned bottle, wherein the fluid jets cooperate with the rotation of the bottle to mechanically peel off layers of beverage product film and residue located at the bottom inner surface of the bottle.

Still yet another object of this invention to provide a high-speed bottle washing machine that provides a spray nozzle and orifice assembly having a plurality of elongated microbores with discharge orifices that are arranged in a predetermined staggered pattern.

Furthermore, an object of this invention is to provide a nozzle spray and orifice assembly that is provided with elongated microbores having an elongated length to diameter ratio to ensure that fluids under pressure exit each corresponding discharge orifice in a focused, well-defined path.

Yet still another object of this invention is to provide a nozzle spray and orifice assembly that is used in a high-speed bottle washing machine wherein the cleaning of the internal bottom surface of the bottle is accomplished in less than 20 seconds, and preferably within 16 seconds.

Yet still another object of the present invention is to provide a high-speed bottle washing machine that includes a manifold and valve block assembly designed particularly for plastic returnable bottles. The manifold and valve block assembly sequentially supplying under pressure a plurality of different cleansing and sanitizing solutions, and also air for residual fluid removal and drying, to the spray nozzle assembly positioned within the rotationally driven bottle being cleaned, and also optionally to spray nozzles positioned externally of the bottle. The spray nozzle assembly is mounted on a lance having a piston which is driven by the different fluids between a fully retracted position within the valve block assembly and a fully extended position in which the spray nozzle is positioned within a bottle being cleaned.

Yet another object of the present invention is to provide a high-speed bottle washing machine having a manifold and valve assembly in which a plurality of valves are mounted in the valve block housing for supplying a plurality of spray fluids to a common manifold which provides a fluid passage to a central fluid flow passageway of the lance for the fluids to be sequentially sprayed through the nozzle. In addition, a static air supply valve supplies static air under pressure to the top of the piston when the lance is in a fully extended position, to drive the lance downwardly to its retracted position. A static dump valve is actuated simultaneously with the static air supply valve which allows, as the lance is driven downwardly by the static air under pressure, any fluid in the drive cylinder to be evacuated therefrom into a collection trough positioned therebeneath.

Still another object of the present invention to provide a mechanical and electronic control system for a high-speed bottle washing machine designed particularly for plastic returnable bottles. The control system automatically regulates each process of the wash spraying system, namely, sequentially feeding bottles from an infeed conveyor means, inverting them by a worm/inverter means, receiving and simultaneously rotating each bottle in an inverted position through a plurality of washing, neutralizing and sanitizing treatment zones, and inverting each bottle to the original neck-up orientation by an egress worm/inverter means and finally conveying them as a cleaned and sanitized bottle to another area for product refilling. The control system provides a plurality of treatment zones for the respective treatment by high-temperature caustic wash solutions, neutralizing solutions and sanitizing solutions, in addition to residual fluid removal and air drying fluids. The control system also actuates spray nozzles initially positioned externally of the bottle which are then driven into each bottle being cleaned.

During the entire process, an electronic programmable logic controller maintains, manages, and controls all pumps, valves, solenoids, and drive motor speeds as required by the process, and also provides for monitoring and adjusting fluid levels, alkalinity/acidity concentrations, and temperature of the recirculated wash solution. A machine operator or attendant may view from a centrally located operator interface, all of the above present machine operating and process parameters. Any alarm conditions that may present themselves during the process are displayed and will prompt for human intervention, interaction, or acknowledgement. Such alarm conditions are: out of range; fluid flow, temperature, pressure, conductivity and/or pH, fluid levels, carousel and bottle RPM, and will include specialized checks for clogged spray nozzles, and out of position fluid lances.

BRIEF DESCRIPTION OF THE DRAWINGS

The foregoing objects and advantages of the present invention may be more readily understood by one skilled in the art with reference being had to the following detailed description of several preferred embodiments thereof, taken in conjunction with the accompanying drawings wherein like elements are designated by identical reference numerals throughout the several views, and in which:

FIG. 5(*b*) illustrates a front view of a PRB holding station shown gripping a 0.5 liter PRB and including the manifold and valve block assembly for the sanitizing carousel;

FIG. 5(*c*) illustrates a front view of a PRB holding station shown gripping a 2.0 liter PRB and including the manifold and valve block assembly for the sanitizing carousel;

FIG. 5(*d*) is a detailed side view of a PRB holding station shown gripping a 0.75 liter PRB and including details of the drive cylinder and the lance positioned within the drive cylinder, and several cam operated valves for supplying various sanitizing and cleansing fluids and air to the lance;

FIG. 5(*e*) illustrates a front view of a PRB holding station shown gripping a 2.0 liter PRB and including the manifold and valve block assembly for the washing carousel;

FIG. 13A-1 is a portion of a piping and instrumentation diagram of the high-speed bottle washing machine of the present invention showing the system components that are monitored and controlled by the programmable logic controller (PLC) and FIG. 13A-2 is the supplementary portion of the diagram;

FIG. 13(*b*) illustrates the various drive motors that are used to provide automatic rotational and translational movement of the various system components and which are monitored and controlled by the control system PLC;

FIG. 13(*c*) illustrates the control element connected to the control system PLC that is used to monitor the vacuum pump seal water supplied to the main vacuum pump of FIG. 13(*d*);

FIG. 13(*d*) illustrates the drive motor that is monitored and controlled by the control system PLC which supplies the main vacuum to the infeed, outfeed and transfer starwheels;

FIG. 13(*e*) illustrates the control element connected to the control system PLC that is used to monitor the air pressure supplied to the system;

FIG. 15(*b*) is a cutaway view of the nozzle body taken along line 15*b*—15*b* of FIG. 16;

FIG. 15(*c*) is a cutaway view of the nozzle body taken along line 15*c*—15*c* of FIG. 16;

DETAILED DESCRIPTION OF THE DRAWINGS

PRB Washing and Sanitizing System

The automatic Plastic Returnable Bottle (PRB) washing and sanitizing system utilizes relatively commonplace bottle handling equipment such as conveyors, worms, inverters, starwheels, etc. and two specialized rotating horizontal carousel type wheels which hold the bottles in place for respective washing and sanitizing.

Figure 1:
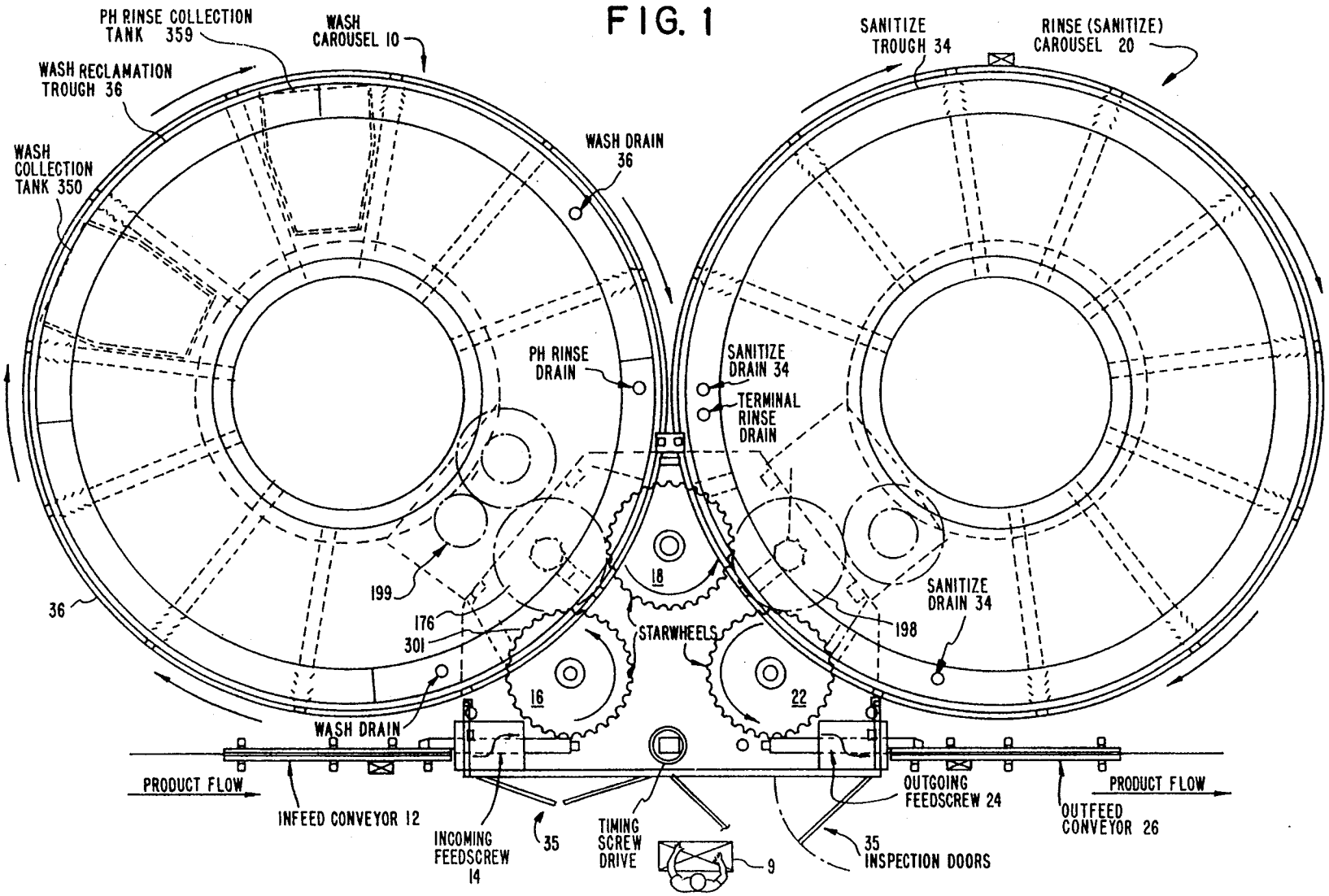
FIG. 1 illustrates a top plan view of the preferred embodiment of the automatic high-speed bottle washing and sanitizing machine of the present invention.

As illustrated in FIG. 1, the wash carousel 10 is provided with a recirculating loop to sustain and maintain temperature, detergent concentrations, liquid volumes, and filtering required to spray clean by impingement the external and internal surfaces of PR bottles.

The sanitize carousel 20 duplicates operationally the wash carousel with the notable exceptions of the spray solutions, the ambient solutions temperatures, special recovery techniques, and the application of a different detergent solution.

1. Temperature. The recirculating wash cycle is automatically controlled and the control system maintains the temperature of the wash solution at approximately 140° F. Controls are analog to provide for finite, precise and continual adjustment against losses incurred by water make-up, ambient room temperatures, air movement, etc.
2. Filtering. The recirculated wash solution is continually filtered or strained to guard against clogging of the spray nozzles, and as will hereinafter be explained in detail, the filters may be cleaned without shutting the machine down.

As the bottle is washed, the solution with attendant soils and debris collects by gravity in a circular ring type trough 36 immediately under the carousel as illustrated in FIG. 1. This trough is fitted around the entire circumference of the wash carousel with a perforated sheet metal that permits water to pass through but captures larger solids and debris. The pitch of this sheet allows the debris to be continually flushed to a low point, easily accessible for manual removal. The water and some smaller solids drain from the trough into a collection/return tank similarly equipped with a perforated metal strainer but with smaller openings to entrap still more solids and debris.

This return solution is now pumped back via a variable frequency drive pump to the wash surge and supply tank. Again, this tank has a perforated metal strainer that removes still smaller entrapped solids and debris and allows the solution to be returned back to the wash carousel via a supply pump and final filtering. Final filtering is accomplished by twin filters connected in parallel, sequentially staged, and fitted with automatic valving for switching from/to dirty/clean filters.

All bottles are machine washed, inside and out simultaneously, using the same cycle times and solutions. The bottles are also rotated between a plurality of stationary external spray nozzles as they are transported by the carousel. The external spray header supplies fluid to a plurality of stationary mounted spray nozzles mounted around the bottles in the carousel which spray fluid onto the bottles' exterior surfaces as the bottles are transported thereby by the carousel.

The operation specifications of one designed embodiment of the washing machine are:

Time—20 seconds per carousel, a constant.
Caustic Solution
Concentration—variable (0–10%)
Temperature—variable (ambient—145° F.)
Pressure—variable (40–200 psig)
Flow rate—nozzle dependent, max 2.5 USGPM
Additives—variable
Time—variable up to 15 seconds
Disinfectant Solution
Concentration—variable (0–1%)
Temperature—ambient
Pressure—variable (0–100 psig)
Flow Rate—nozzle dependent, max 1.5 USGPM)
Additives—variable
Time—variable up to 15 seconds
Water Rinse
Temperature—ambient
Pressure—variable (0–100 psig)
Flow Rate—nozzle dependent, max 2.5 USGPM)
Additives—variable
Time—variable—balance of 15 seconds
Nozzles—selected to suit bottle shape, flow rate, spray pattern
Bottle Rotation—variable—clockwise/counterclockwise (0–60 rpm)

As shown in FIG. 1, all of the wash solution collects in a separate drain trough 36 and gravity returns to a collection tank, from which the wash solution is pumped back to the wash surge/supply tank to complete the circuit.

Both the caustic wash solution and the neutralizing solution are pumped through flow monitoring elements, which as will be explained below, are very sensitive flow (pressure) measuring device for measuring small differences in flow rates. Should a spray nozzle or lance be plugged, the signal rate will be lower and the suspect nozzle(s) is flagged and retained in PLC memory. That particular station or stations and more importantly, their corresponding bottles, are held in memory throughout the bottle flow sequence. Those bottles are then identifiable for subsequent inspection and rejection stations and may then be rejected as being of uncertain quality.

As will be hereinafter discussed in detail, a recirculating wash circuit of the wash carousel stands alone in its operation, and is essentially a loop where solution strength, filtering, levels and temperature are monitored, adjusted and maintained to operating specifications. The control strategy meets make-up conditions imposed by migration of solution by bottle carryover, evaporation and dilution. In addition, flows and pressures are continuously monitored for overall performance data, and assist in detecting component discrepancies: wear, erosion, leakage, etc.

A separate diverter loop circuit maintains temperature and pressure while preventing over exposure of the spray contact time to the bottles should the carousel be in an idle or resting mode.

Bottle Flow Sequence

Referring to FIG. 1, bottles enter a first wash carousel wheel 10 by an infeed conveyor 12, are inverted by a worm/inverter 14, and then proceed through a starwheel infeed means 16 which grips each inverted bottle by a vacuum holder. While circular carousels are illustrated in the drawings as one means of providing an endless loop, it should be noted that other endless loop configurations, such as those used for inline rinsers could also be used. The endless loop provides an extended duty wash cycle in a high speed conveyor, whereby bottles traveling at the preferred rate of 440 per minute or 24,000 bottles per hour, may be washed for an extended, i.e., 15 to 20 second wash cycle. The extended duty cycle being therefor a function of the length of the perimeter of the endless loop and the speed at which the bottles are supplied via the conveyor.

Figure 4:
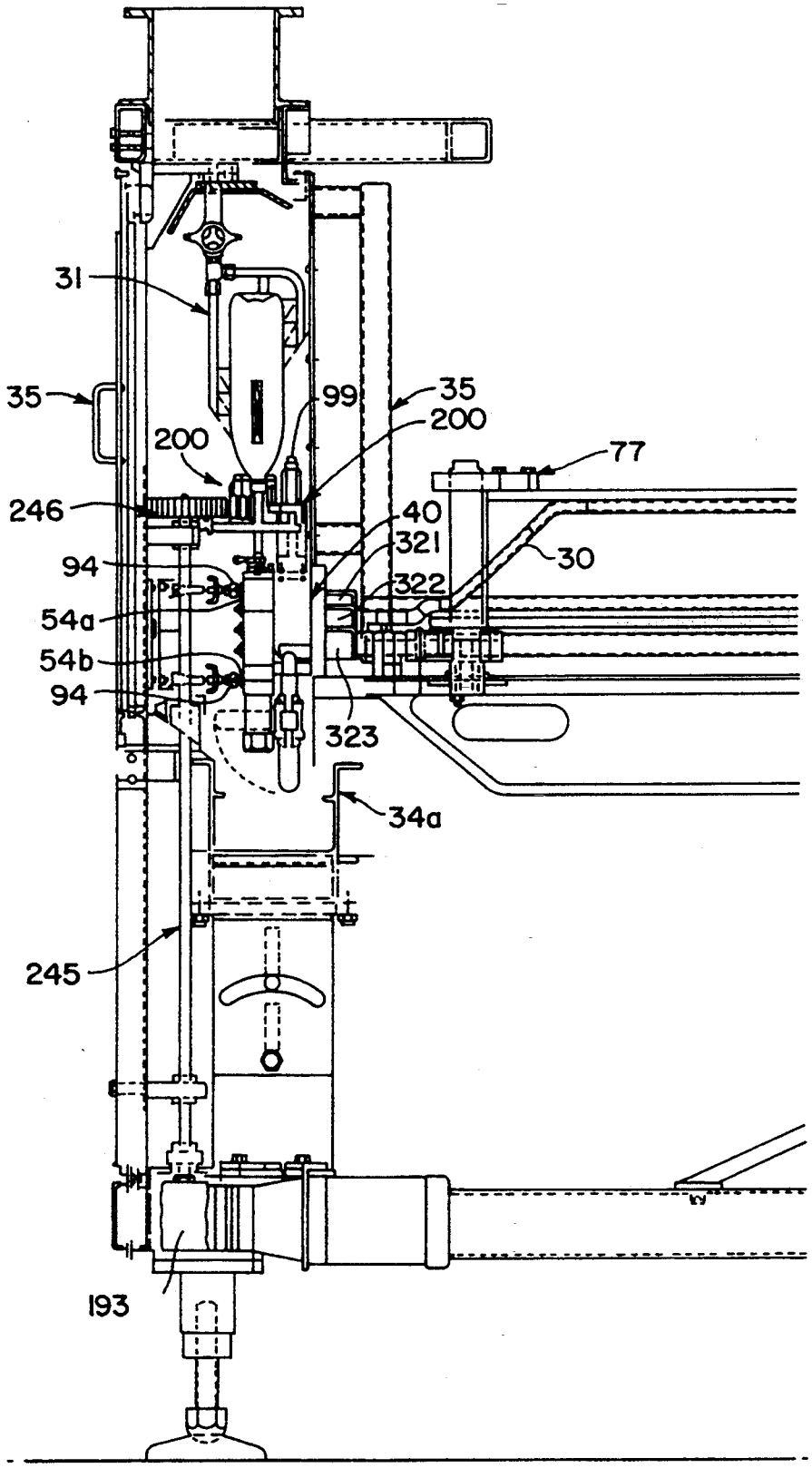
FIG. 4 is an enlarged partial sectional view of the wash carousel shown in FIG. 2, and illustrates control cams simultaneously actuating a static air valve and a static air dump valve, the fluid flow conduits in the machine, and also a wash reclamation trough positioned beneath the first wash carousel.
Figure 5A:
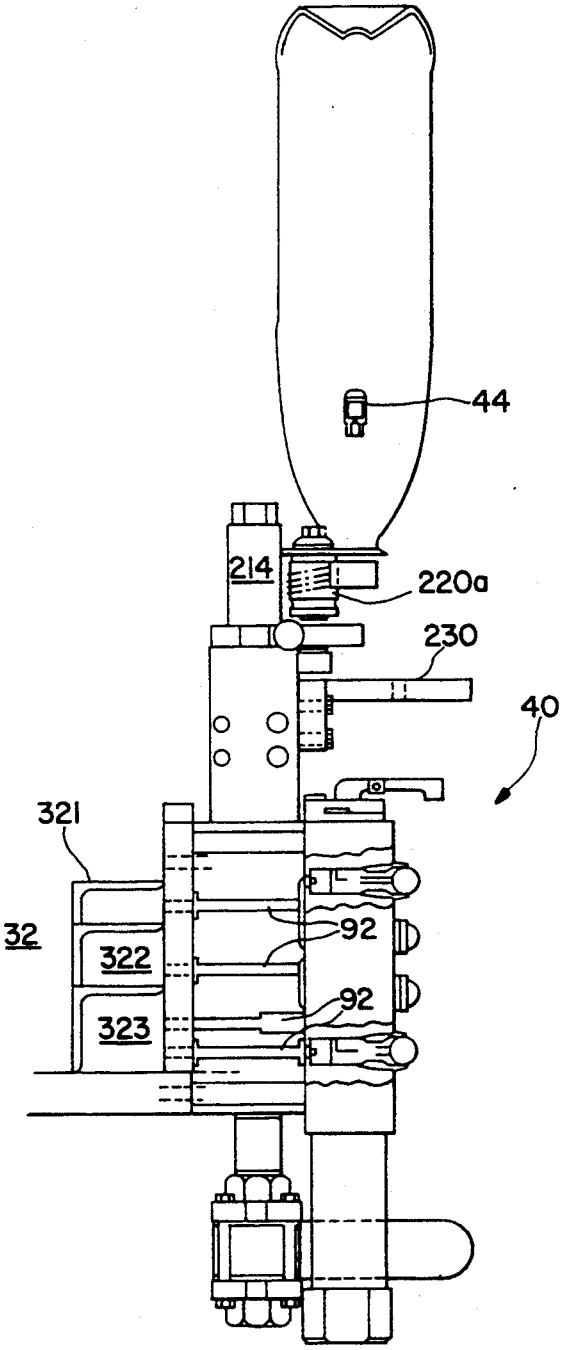
FIG. 5(*a*) illustrates a side view of a PRB holding station shown gripping a 1.5 liter PRB and including a section of the manifold and valve block assembly for the sanitizing carousel having several annular supply manifolds for supplying fluids to the valves, and also illustrates a sectional view through and the operation of two of the supply valves.
Figure 5B:
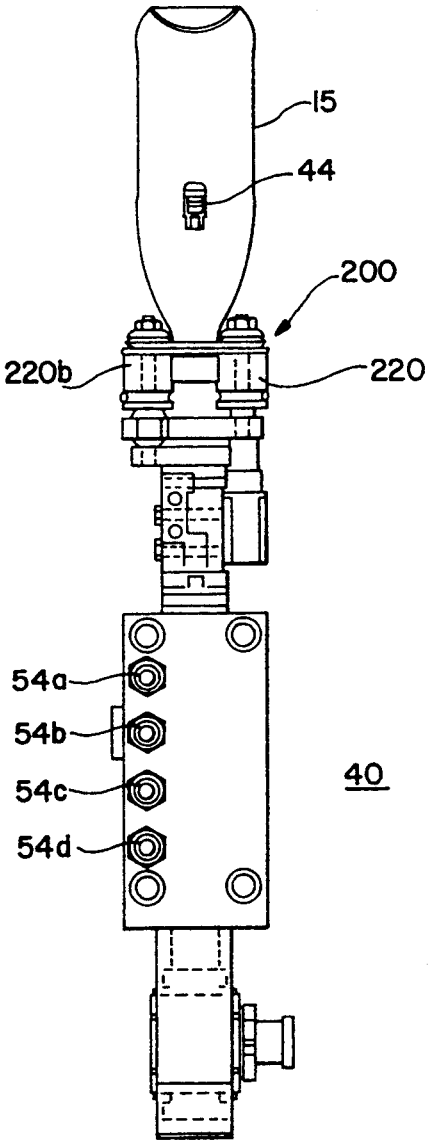
Figure 5C:
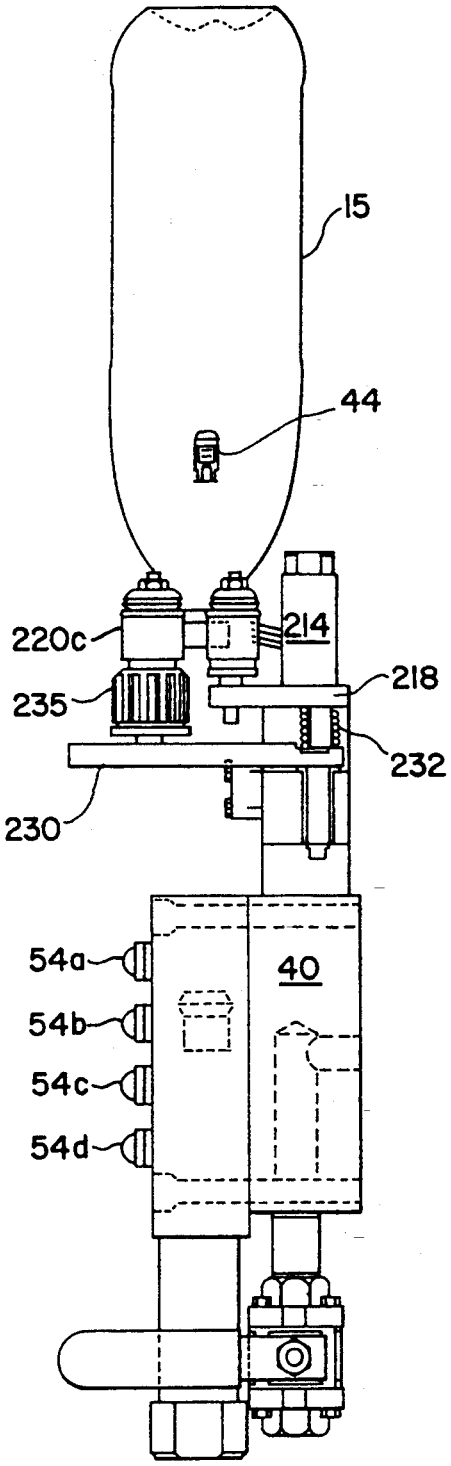
Figure 5D:
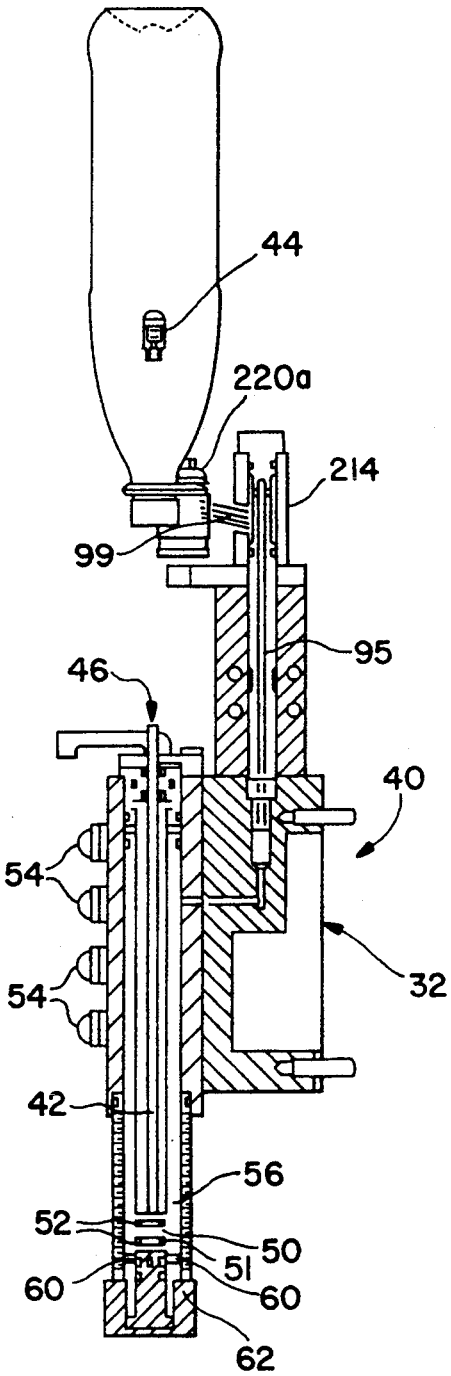
Figure 5E:
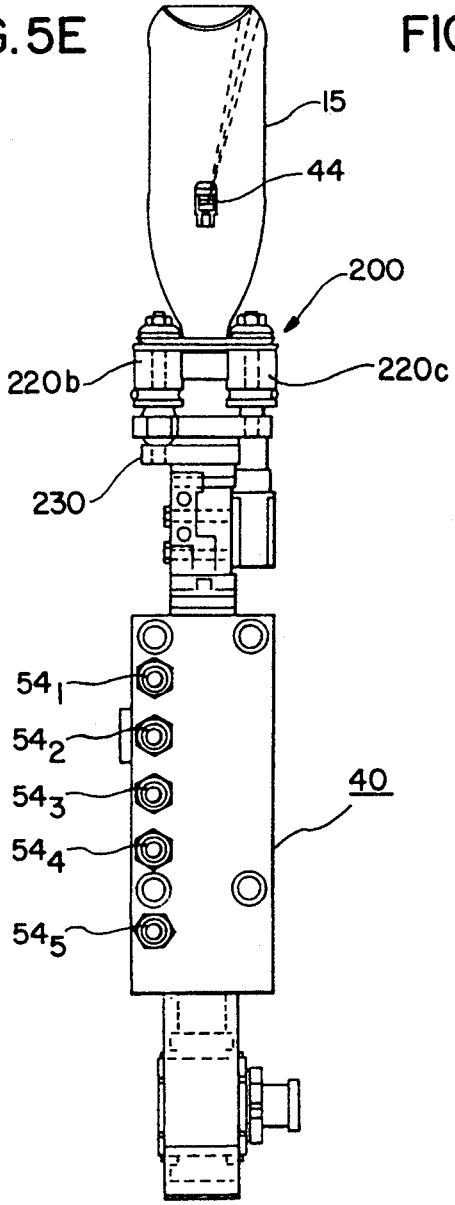

To minimize scuffing and abrasion to external bottle surfaces, the several devices are designed to handle the bottles with minimum mechanical contact, and are equipped with suction cups, vacuum nozzles, air jets, etc. to affect bottle conveying. Once transferred to the first wash carousel 10 in a neck down position as illustrated in FIGS. 4, 5(*a–e*) and 6, a bottle is gripped around its neck ring by bottle holding apparatus 200 as described in greater detail below, and held in position throughout its traverse of the carousel. The neck ring gripper/rollers of bottle holder and rotating assembly 200 are powered by drive motors, one of which is illustrated as 193 in FIG. 4 and belts 246 (FIGS. 4 and 11) that impart a controlled spinning action to the bottle, as will be hereinafter discussed in greater detail. The controlled spinning or rotation is very effective for both washing and sanitizing as it provides for maximum coverage of solutions at minimum volumes to both the internal and external surfaces of the bottle.

Figure 3:
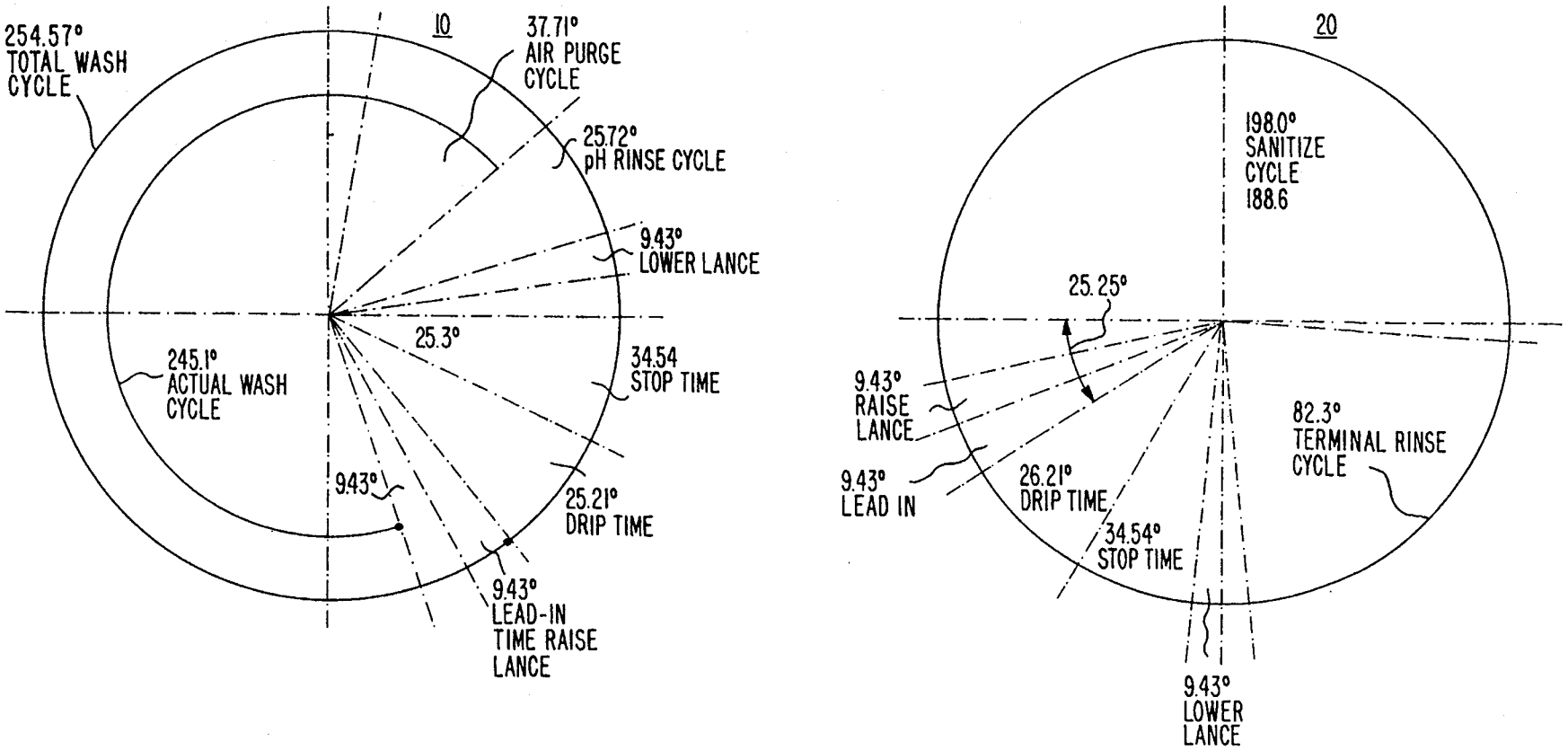
FIG. 3 illustrates the timing cycles of the two carousels, including in the wash carousel, a lead-in lance raise cycle (arc), an alkaline wash cycle, a neutralize rinse cycle, and a lower lance cycle, and in the sanitize carousel, a lead-in lance raise cycle, a sanitize rinse cycle, a terminal rinse cycle, and a lower lance cycle.

FIG. 3 illustrates the following timed cycles or sequences by appropriate arcs around the first wash carousel and the second rinse carousel. After a bottle is placed into the carousel, there is an initial 9.43 degree lead-in arc. As a bottle is conveyed through the next 245 degrees of the first wash carousel, it is sprayed both internally and externally by a hot alkaline solution that solubilizes and removes typical soils found in returned used beverage bottles. A lance with a spray nozzle at its tip is inserted into each bottle during the first 9.43 degrees of the 245 degree arc. As will be described in detail below in view of FIGS. 6 and 14, the internal spraying is by a specially designed spray nozzle assembly 301 mounted on a lance which is driven by a fluid driven piston. The lance has an exact and precise travel distance within the confines of the bottle envelope and is lowered or recalled by air pressure just prior to the bottle leaving each carousel.

At the end of the 245 degrees conveyance (12 sec), 38 degrees (2 sec) of travel are allocated for an air purge/evacuation of residual alkaline solution within the bottle. With the lance still extended, this air purge is followed immediately by a neutralizing, or slightly acidic rinse for a 26 degree duration, and then the lance is lowered during a 9.43 arc. This approach minimizes the time waiting for gravity drainage of solutions to provide for the recovery and reutilization of the solution.

The bottle is then transferred by a transfer starwheel 18 shown in FIG. 1 to a second sanitizer carousel 20 which is substantially identical in size and number of stations to the first carousel, and differs only slightly in structure from the wash carousel because of its different function. During conveyance by the second sanitizer carousel 20, the first 9.43° arc is allocated to bottle lead-in time, followed by a 198 degree arc allocated to the application of a sanitizing solution only to the interior of the bottle. The first 9.43 degrees of the 198 degree arc is allocated for lance raise time. This is followed by a final or terminal rinse of treated water applied to both internal and external bottle surfaces for approximately 82.3 degrees, followed by a 9.43° lance lower arc.

In both carousels a plurality of stationary exterior spray nozzles 31, as illustrated in FIG. 4 are positioned about the path traversed by the bottles as they are carried by the carousel from the bottle infeed starwheel to the bottle outfeed starwheel. The nozzles 31 are supplied with a wash solution at the wash cycle portion of the fixed perimeter of the wash carousel, and a neutralizing solution during the neutralizing portion of the fixed perimeter of the wash carousel. A sanitizing solution is provided during the sanitizing portion of the fixed perimeter of the sanitize carousel and a water rinse during the final rinse portion of the rinse carousel. It should be noted that the rotation of the bottles also enables thorough cleaning of the bottle exterior, even though nozzles 31 are fixed.

In both carousels, at the end of each treatment, free clean air is applied to an external stationary (does not rotate with the carousel) spray nozzle positioned above the bottoms of the inverted plastic returnable bottles to blow off any residual liquids in the concave bottoms of the inverted bottles to provide maximum recovery and minimum migration of cleaning and sanitizing fluids. In greater detail, one such stationary nozzle is positioned above the inverted bottles at the end of the wash cycle, one such stationary nozzle is positioned above the inverted bottles at the end of the pH rinse cycle, one such stationary nozzle is positioned above the inverted bottles at the end of the sanitize cycle, and one such stationary nozzle is positioned above the inverted bottles at the end of the terminal rinse cycle.

Figure 2:
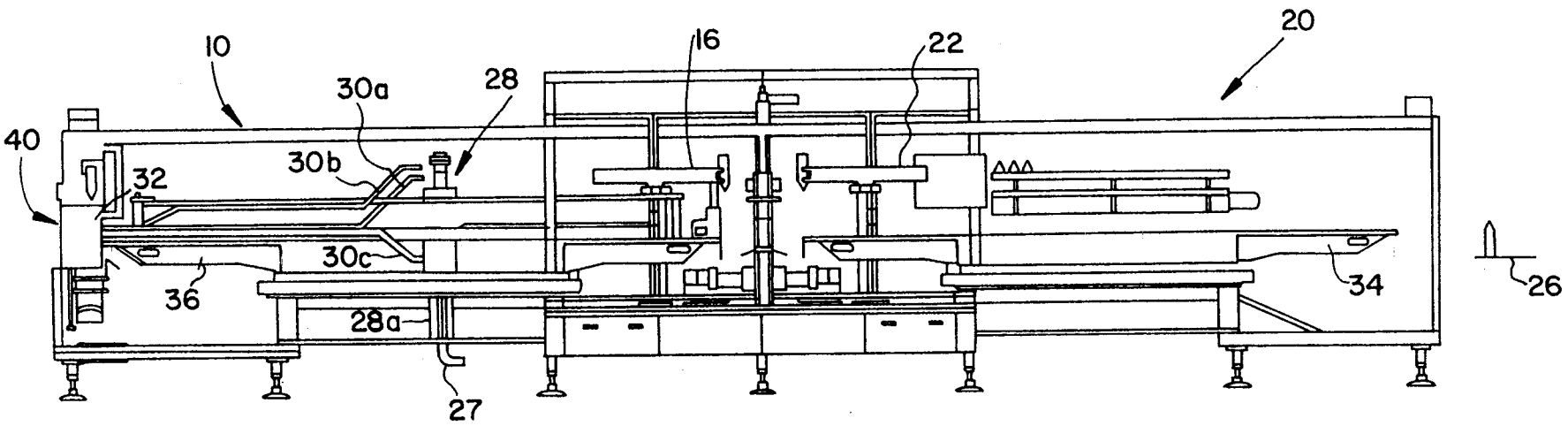
FIG. 2 is an elevational view of the automatic high speed bottle washing and sanitizing machine showing the rotary union and fluid supply lines leading to the manifold and valve block assembly of the washer carousel of the present invention.

The bottles are then removed from the rinse carousel by an outfeed starwheel means 22 as shown in FIGS. 1 and 2, and transferred to an outgoing feedscrew 24 which again inverts the bottle again to its original neck up position, from which it is conveyed at 26 as a cleaned and sanitized package to the product filler.

During this whole process as will be described in detail below, a programmable logic controller (PLC) maintains, manages, and controls carousel, infeed/outfeed conveyors, and bottle rotation drive motor speeds based on feedback from the downstream bottle filler. Additionally, the PLC monitors and controls pumps, valves, solenoids, motor starters, as required by the process and also provides for monitoring and adjustment of fluid levels, alkalinity/acidity concentrations, and temperature of the recirculated wash solution.

As illustrated in FIG. 1, a machine operator may view, from a centrally located intelligent operator interface 9, all of the present machine operating parameters displayed on various alpha-numeric screens of the interface. Accordingly, any alarm conditions that may occur during the process and require some type of human interaction or intervention are displayed, and will prompt for an operator acknowledgement.

Some alarm conditions are out of range: flow, temperature, pressure, conductivity and/or pH, fluid level, and carousel rpm. Separate and specialized checks for clogged spray nozzles, lances out of position, fouled line strainers, etc may also be performed. Safety related items are shown as alarm conditions as well, for example, inspection doors 35 open, overtemp condition, exhaust fan not running, utilities pressures too low to start, lubrication required, etc.

As illustrated generally in FIG. 2, the wash carousel 10 and the sanitize carousel 20 both include a central rotary commutator 28, with fluid supply lines 30*a,b* each of which extends to a separate fluid supply annular manifold 32 extending around the inner circumference of the carousel annulus, one of which is also shown illustrated in FIG. 4. A second commutator 28*a* is provided for the wash carousel to transfer the hot caustic wash solution from the infeed pipe 27 to the rotating supply line 30*c*. Expansion joint 77 is provided to accommodate movement of the annular manifold 32 with respect to the carousel platform 36 and will allow the annular manifold to expand when heated as the pressurized high temperature caustic wash solution flows through a fluid supply line through the annular manifold 32 to the plurality of spray nozzles.

As shown in FIG. 4, a plurality of external spray nozzles 31 are mounted around the bottles to clean and sanitize the external surfaces thereof. In a preferred embodiment, the external spray nozzles 31 are fixed and do not rotate with the carousel, and are mounted at selected positions around the rotating carousels where the external surfaces of the bottles are to be sprayed with a caustic wash or other treatment fluid. In greater detail, the external spray nozzles are positioned along the travel arc of the wash cycle, along the travel arc of the pH rinse cycle, and can optionally be positioned along the travel arc of the sanitize cycle, and along the travel arc of the terminal rinse cycle. The stationary external spray nozzles have a separate fluid supply lines (not through annular manifold 32) since they do not rotate with the carousel.

Bottle Receiving Stations

As illustrated by FIGS. 4, 5(*a*)–5(*e*) and 6, (FIGS. 4 and 5(*a*) are oriented 180° apart) each inverted bottle has a separate bottle receiving station which includes a manifold and valve block assembly 40 associated therewith. Each separate manifold and valve block assembly 40 has a central lance 42, which is longitudinally slidable between a first fully withdrawn position below the bottom, illustrated in FIG. 5(*d*), and a second fully extended position within the bottle, illustrated in detail in FIG. 6 and shown schematically by the position of a nozzle 44 at the upper end of the lance, shown within the bottle 15 in FIGS. 4–6. As will be explained in detail below, the spray nozzle 44 is removably attached by threaded engagement to the top 46 of the lance 42 to allow cleaning or replacement of the spray nozzle. As will be explained below, different spray nozzles having different spray patterns may be provided for different plastic returnable bottles to match the different internal contours and sizes of the various plastic returnable bottles to be washed.

During a first 9.43° arc of the carousel wash cycle time, as illustrated in FIG. 3, the lance is fully extended, driven by the fluid pressure of the fluid supplied to the nozzle, to position the nozzle properly within the bottle, and during a final 9.43° arc of carousel lead-out time, as illustrated in FIG. 3, the lance is withdrawn from the bottle, driven downwardly by air pressure to the position shown in FIG. 5(*d*).

As shown in FIGS. 5(*d*) and 6, the lance 42 includes a central stem portion having a central fluid flow passageway 48 therein, and a lower drive piston 50 fitted with one O-ring seal 52 and a Teflon® guide ring 51. The lance is initially driven to its fully extended position by supplying fluid (alkaline wash solution in the wash carousel and sanitizing solution in the sanitizing carousel) under pressure from one of several valves 54 associated with each valve block assembly. The drive piston 50 travels within a stationary drive cylinder 56 within each valve block assembly by the fluid flowing through an appropriate actuated (open) valve 54 into a common annular flow passage or manifold 58 defined around the stationary drive cylinder 56 to ingress orifices 60 near the bottom of the drive cylinder 56 to an open volume beneath the piston defined by a lower resilient snubber 62. The pressurized fluid drives the piston 50 from its lower position in which the bottom of the piston rests upon the top of the lower resilient snubber 62 as in FIG. 5(*d*) to a fully extended top position in which the top of the piston is driven against the bottom of an upper resilient snubber 64 as shown in FIG. 6.

The lance is driven, at an appropriate time, downwardly from its fully extended position to its fully retracted position by static air under pressure which passes through a top static air supply valve 54 through ingress flow orifices 66 near the top of the drive cylinder 56 to the top of the piston 50, in its upper extended position, which drives the piston and lance downwardly, within the drive cylinder 56 until the piston contacts the top of the lower resilient element 62, as illustrated in FIG. 5(*d*).

The drive cylinder includes at its lower end an outer O-ring seal 68, immediately below the ingress fluid flow passages 60, and terminates at an externally threaded lower end 70. The lower end is sealed by a bottom end cap 72 which is internally threaded to engage the externally threaded end 70 of the cylinder. The bottom resilient snubber 62 is secured in place between the inside of the threaded cap and the end of the cylinder, and includes an outer annular O-ring seal 74, and extends upwardly therefrom inside the drive cylinder to the ingress fluid flow passages 60. The upper end thereof is shaped to allow fluid flowing through the ingress fluid flow passages 60 to contact the bottom end of the piston at the lower end of the lance to drive the lance upwardly and the fluid then flows through the central passage 48 in the lance to the spray nozzle.

Figure 6:
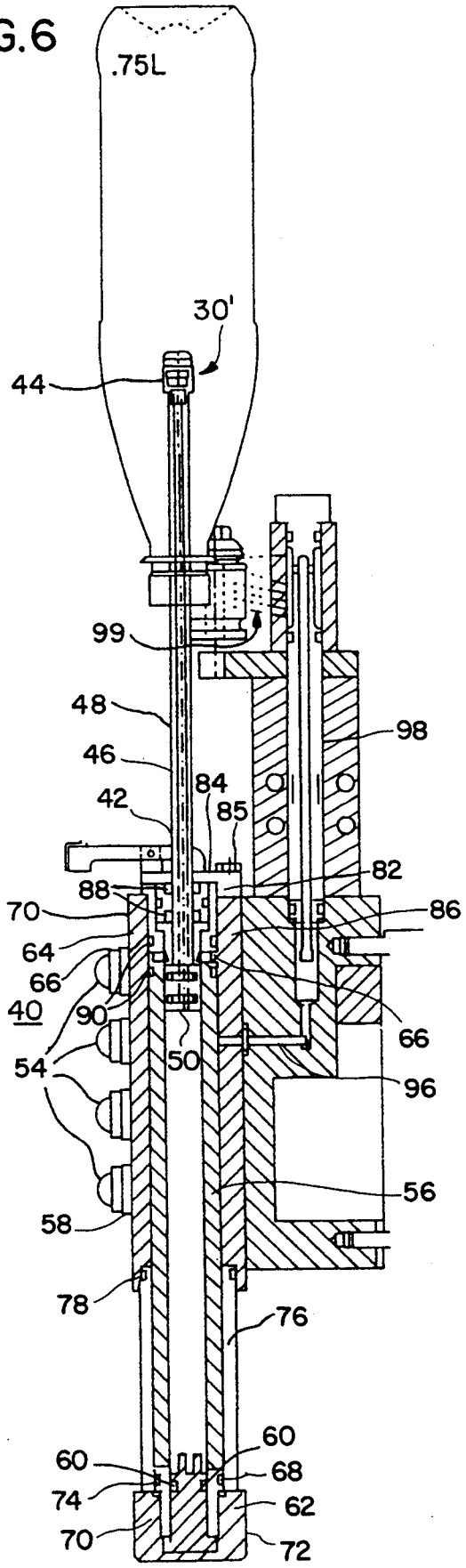
FIG. 6 is a view of the periphery of the wash carousel showing a PR bottle station including a bottle holder and rotating device holding a PRB in an inverted position with a spray lance and nozzle fully extended within the confines of the bottle.

The annular fluid flow passage 58 in the manifold block is continued downwardly, as illustrated in FIG. 6, from the manifold block to the lower cap by a cylindrical extension 76 having an O-ring seal 78 at its upper end to seal to the manifold block, and is sealed at its bottom by the O-ring seal 68 around the bottom of the cylinder 56. The cylindrical extension is held firmly in place by engaging the top of the bottom cap 72.

The upper end of the driving cylinder includes a larger diameter section 82, and the upper end of the driving cylinder is held in place by an upper cap element 84 joined to the manifold block by bolts 85. A top sealing plug 86 is secured in place in the larger diameter section 82 beneath the upper cap member 84 and carries two spaced inner O-ring seals 88 which seal against the outer cylindrical surface of the lance, and an outer O-ring seal 90 which seals against the inner surface of the driving cylinder 56. The top resilient snubber 64 is held in place beneath the top sealing plug 86 and includes a resilient lower surface, against which the upper surface of the driving piston is driven when the lance is extended.

As illustrated particularly by FIGS. 5(*d*) and 6, the common supply manifold 58 also communicates by a flow passage 96 with an external spray manifold 98 which supplies fluid to external spray nozzles 99 which are mounted on and rotate with the carousel and spray fluid onto the exterior surfaces of the bottle at the top and neck ring. In some embodiments, the external spray nozzles 99 may not be required, and in these embodiments the flow passages to these nozzles may be blocked, or alternatively the external spray nozzles and flow conduits thereto may be eliminated.

Figure 7:
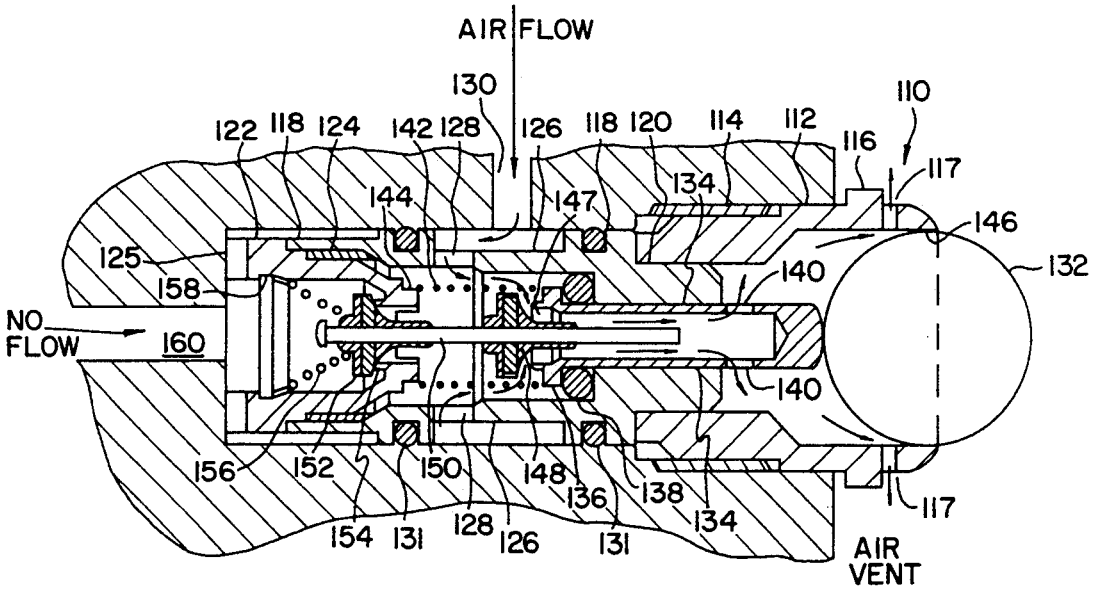
FIG. 7 illustrates a sectional view through one of the static air three-way valves when the valve is in a closed position.
Figure 8:
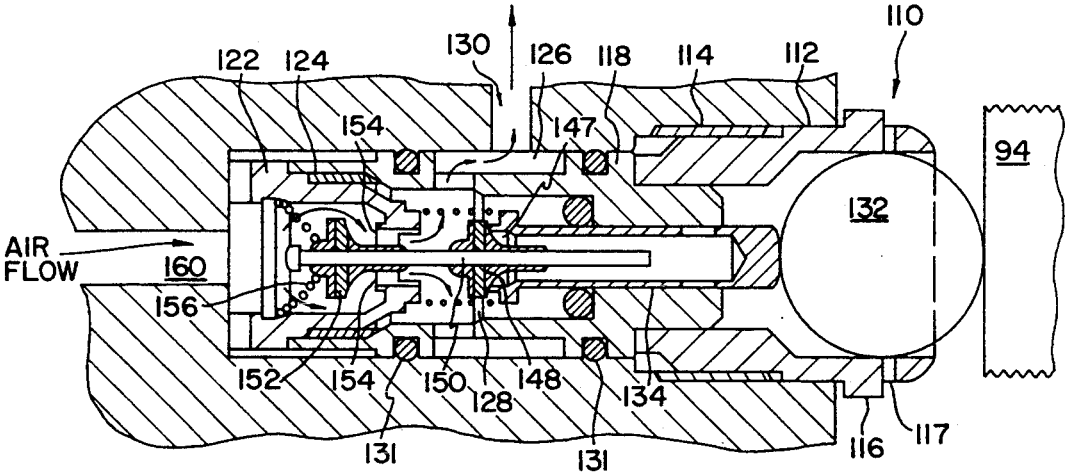
FIG. 8 illustrates a sectional view similar to that of FIG. 7 when the static air three-way valve is actuated to an open position.

The valves 54 of the valve block assembly are mounted in the manifold block adjacent to the drive cylinder, as shown specifically by FIGS. 5(*a–e*) and specified by FIGS. 7 and 8.

As illustrated in FIGS. 4 and 5(*a*), the annular manifold 32 defines a plurality of inner annular supply manifolds 321, 322 and 323 which are secured to the outer perimeter of each carousel. They supply a plurality of fluids under pressure to the inlet of their associated supply valve 54*a*–54*d*. As shown by FIG. 5(*a*), each supply manifold 321–323 communicates by a fluid flow passageway 92 extending from the supply manifold to the intake of an associated valve.

Each valve 54 is actuated at appropriate times, as indicated by the timing charts illustrated by cam tracks 94 positioned around the outer periphery of each carousel. FIG. 4 illustrates the simultaneous actuation of a static air valve $\mathbf{54}_1$ and a static dump valve $\mathbf{54}_5$, (illustrated in FIG. 5(*e*)), of a single bottle receiving station of the wash carousel 10.

The construction of the wash carousel and the construction of the sanitizing or rinse carousel are substantially the same. In each carousel, the upper supply annulus 321 supplies static air under pressure, used to lower the lance near the end of a cycle of each carousel, to each static air supply valve $\mathbf{54}_1$ in the washer carousel 10 (FIG. 5(*e*)) and $\mathbf{54}_a$ in the sanitizer carousel 20 (FIG. 5(*b*)). The wash carousel includes a fifth valve element $\mathbf{54}_2$, shown in FIG. 5(*e*), to supply purge air to the wash carousel during the air purge cycle to evacuate alkaline wash solution from the drive cylinder and its associated flow passages and also from the inside of the bottle. As illustrated by FIG. 5(*e*), the arrangement of valves of a PRB station in the washer carousel 10 is slightly different from that in the sanitizer carousel 20. In the washer carousel 10, the second valve from the top $\mathbf{54}_2$ is the air purge supply valve, and the static air dump valve $\mathbf{54}_5$ is now the fifth valve from the top.

The lower annular supply manifold 323 supplies alkaline wash solution (NaOH) to valve $\mathbf{54}_4$ of the wash carousel during the major wash cycle, and in the sanitizer carousel supplies sanitizing solution ($HNO_3$) during the major sanitizing cycle. The middle supply annulus 322 supplies neutralizer rinse to valve $\mathbf{54}_3$ of the wash carousel during the PH rinse cycle, and in the rinse carousel supplies terminal rinse solution (soft water) during the terminal rinse cycle.

The bottle receiving stations on the sanitizer carousel have four valves $\mathbf{54}_a$–$\mathbf{54}_a$ associated therewith, as illustrated in FIGS. 4 and 5(*b*), with the top valve $\mathbf{54}_a$ supplying static air, the next lower valve $\mathbf{54}_b$ being a static air dump valve. Valves $\mathbf{54}_a$ and $\mathbf{54}_b$ are actuated simultaneously during a lance lowering operation with valve $\mathbf{54}_a$ supplying air through passages 66 (FIG. 6) to lower the lance and valve $\mathbf{54}_b$ allowing air to be driven from the system when the lance is lowered. The next lower valve $\mathbf{54}_c$ supplies terminal rinse solution during the terminal rinse cycle, and the lowest valve $\mathbf{54}_d$ supplies sanitizing solution during the sanitizing cycle.

The construction of the manifold valve and block assembly as described hereinabove provides for the ready disassembly of each manifold valve and block assembly, to provide for inspection, cleaning and replacement of the several components thereof. Each end cap 72 can be unscrewed to allow removal of the lower resilient snubber 62, and the cylindrical extension 76. At the upper end, the bolts 85 can be removed, which allows removal of the cap 84, the upper seal plug 86, the upper snubber 64, and the lance 42.

FIG. 7 illustrates a sectional view through an exemplary three-way static air actuating valve assembly 110 in a closed position (no static air flow) which shows the path of air being vented through the three-way valve. The air vent path is provided to allow air to be vented from above the drive piston when the lance 42 is being driven from its retracted position to its extended position. FIG. 8 illustrates a sectional view through the valve 110 of FIG. 7 in an open position which allows static air to flow through the valve, but closes off the vent path.

The valve 110 includes a first housing member 112 with external threads 114 which threadedly engage a threaded bore in the manifold housing. A hex head 116 is provided to screw (and unscrew) the valve 110 relative to the manifold housing. A plurality of vent ports 117 are provided in the first housing member 112 adjacent to the hex head 116 which extend between the interior and exterior of the first housing member.

A second housing member 118 includes a reduced diameter right end 120 which is inserted into a cylindrical bore in the left end of the first housing member 112. An end cap 122 closes the left end of the valve assembly and includes outer threads 124 which engage corresponding threads in a bore at the left end of the second housing member 118. The end cap includes a recess 125 at its left end to enable the end cap to be screwed into and out of the second housing member 118. The valve assembly 110 is screwed (by threads 114 and hex head 116) into the manifold housing until the left end of the end cap 122 contacts the manifold housing, which holds all of the components securely in position.

The second housing member 118 includes an outer reduced diameter flow section 126 which communicates with ports 128 communicating with the interior of the second housing member 118, and also communicates with an air flow passage 130 in the manifold housing. Two O-ring seals 131 extend around the circumference of the second housing member 118 to seal it relative to the manifold housing. The valve includes a ball actuator 132 movably mounted within the right end of the first housing member 112 which is actuated (pushed in) by one of the cam rails 94 from the position illustrated in FIG. 7 to the position illustrated in FIG. 8. Upon actuation, the ball actuator 132 linearly displaces to the left a centrally mounted cylindrical actuator 134 movably mounted in a central bore in the second housing member 118. An external flange 136 is provided near the left end of the cylindrical actuator 134, and an O-ring seal 138 is positioned around the cylindrical actuator 134 in an internal bore of the second housing member 118, providing a seal therebetween. The cylindrical actuator 134 is hollow and includes ports 140 near its right end communicating with the interior of the first housing member. A cylindrical spring 142 extends between the external flange 136 of the cylindrical actuator 134 and an annular lip 144 at the right end of the end cap 122, and biases the cylindrical actuator 134 and the ball actuator 132 to the right, until the ball actuator 132 seats against a reduced diameter lip 146 at the right end of the first housing member 112.

When the ball actuator 132 is displaced to the left by a cam rail 94, the cylindrical actuator 134 is displaced to the left until its left end, which forms a vent valve seat 147, is closed against a vent valve member 148 of a centrally mounted valve stem assembly 150. The valve stem assembly 150 includes a main valve member 152, which in the closed position of the valve illustrated in FIG. 7, is closed against a main valve seat 154 formed on the end cap 122. A conical spring 156 extends between an inner annular lip 158 formed in the end cap 122 and the left side of the vent valve member 152, and biases the valve stem assembly 150 to the right, such that in the closed position of the valve illustrated in FIG. 7, the vent valve member 152 is closed against the vent valve seat 154. In this position, the main valve member 148 is open relative to the main valve seat 147.

Accordingly, in the closed position of the valve 110 illustrated in FIG. 7 static air cannot flow (from the static air annular manifold) through an inlet port 160 in the valve 110 past the main valve member 152 which is closed against the main valve seat 154. However, air can be vented from air flow passage 130, through reduced diameter flow section 126, ports 128 into the interior of the second valve housing member 118, through opened vent valve member 148 (opened relative to vent valve seat 147) into the interior of cylindrical actuator 134, through ports 140 into the interior of the first valve housing member 112, and out to the atmosphere through ports 117.

In arriving at the open position of the valve 110 illustrated in FIG. 8, as the ball actuator 132 is displaced to the left by a cam rail 94, the ball actuator 132 displaces the cylindrical actuator to the left, thus closing the vent valve seat 147 against the vent valve member 148, and then displacing the valve stem assembly 150 further to the left, opening the main valve member 152 relative to the main valve seat 154, to the position illustrated in FIG. 8. In this position, static air flows (from the static air annular manifold) through inlet port 160 through opened main valve member 152 to the interior of the second housing member 118, through ports 128, reduced diameter flow section 126, and into the outlet port 130. The outlet port 130 communicates with the inlet ports 66, FIG. 4, to drive the lance 42 to its retracted position.

FIGS. 7 and 8 illustrate the construction of a three-way valve which is used as the static air valve $54_a$ of the sanitize carousel 20 and the static air valve $54_1$ of the wash carousel 10. The other valve members $54_b$ through $54_d$ of the sanitize carousel 20 and $54_2$ through $54_5$ of the wash carousel 10 only require a two-way valve. The construction of each of the two-way valves is substantially identical to that of the three-way valves, except that the two-way valves do not have ports 117 in the first housing member 112 and ports 140 in the cylindrical actuator 134. The advantage of this arrangement is to allow all of the valves to have a substantially similar construction with many common parts. In the two-way valves, only the function of the main valve member 152 and main valve Seat 154 is utilized, to allow or foreclose flow from the inlet port 160 to the outlet port 130. In the two-way valves, fluid from the outlet port 130 communicates by flow passageways to the common annular manifold 58, FIG. 6, then flows through the inlet ports 60 to the central passage 48 of the lance 42, to drive the lance upwardly to its extended position, or if the lance is already in its extended position, to simply spray through the nozzle 44.

Bottle Holder and Rotating Assembly

Figure 9:
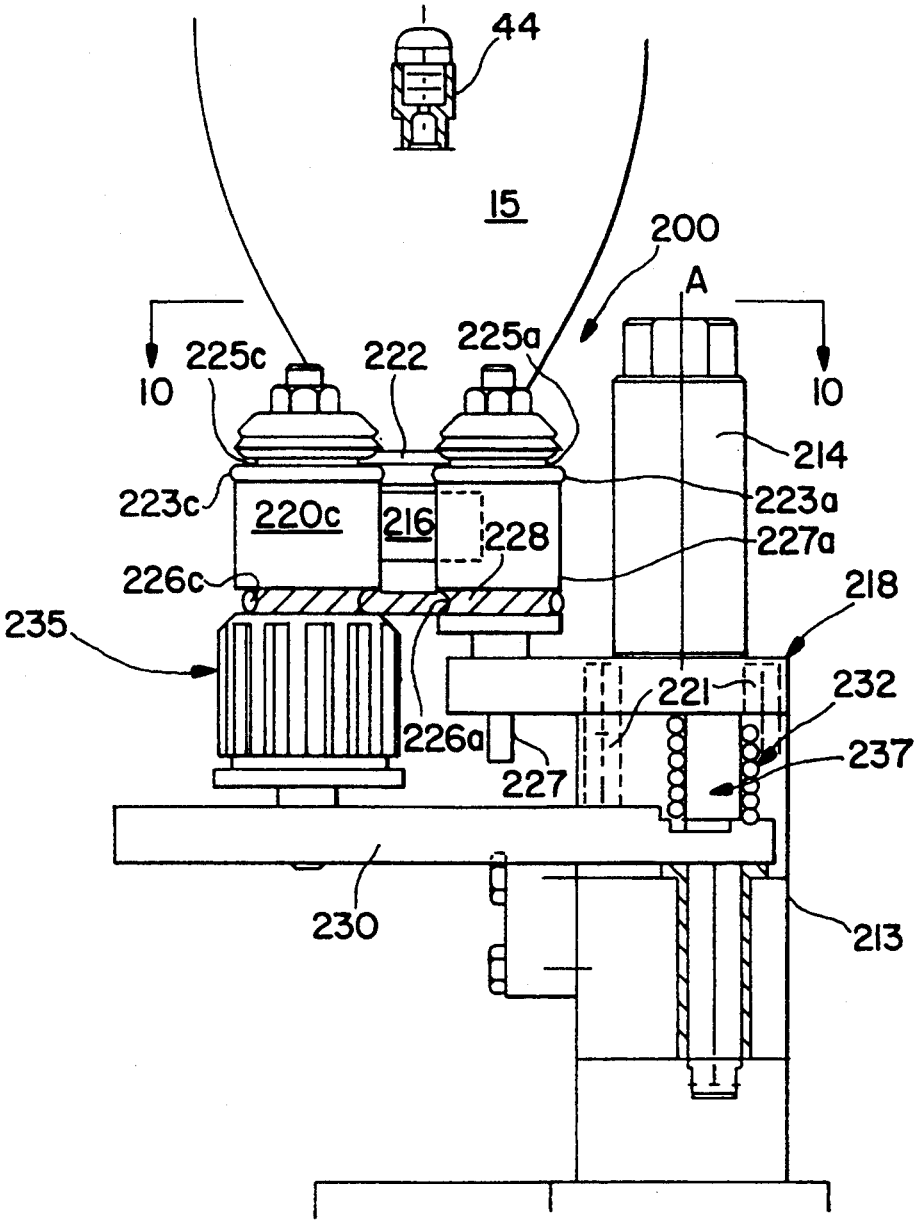
FIG. 9 is a detailed side view of the bottle holder and rotating apparatus shown gripping a bottle in an inverted position.
Figure 10:
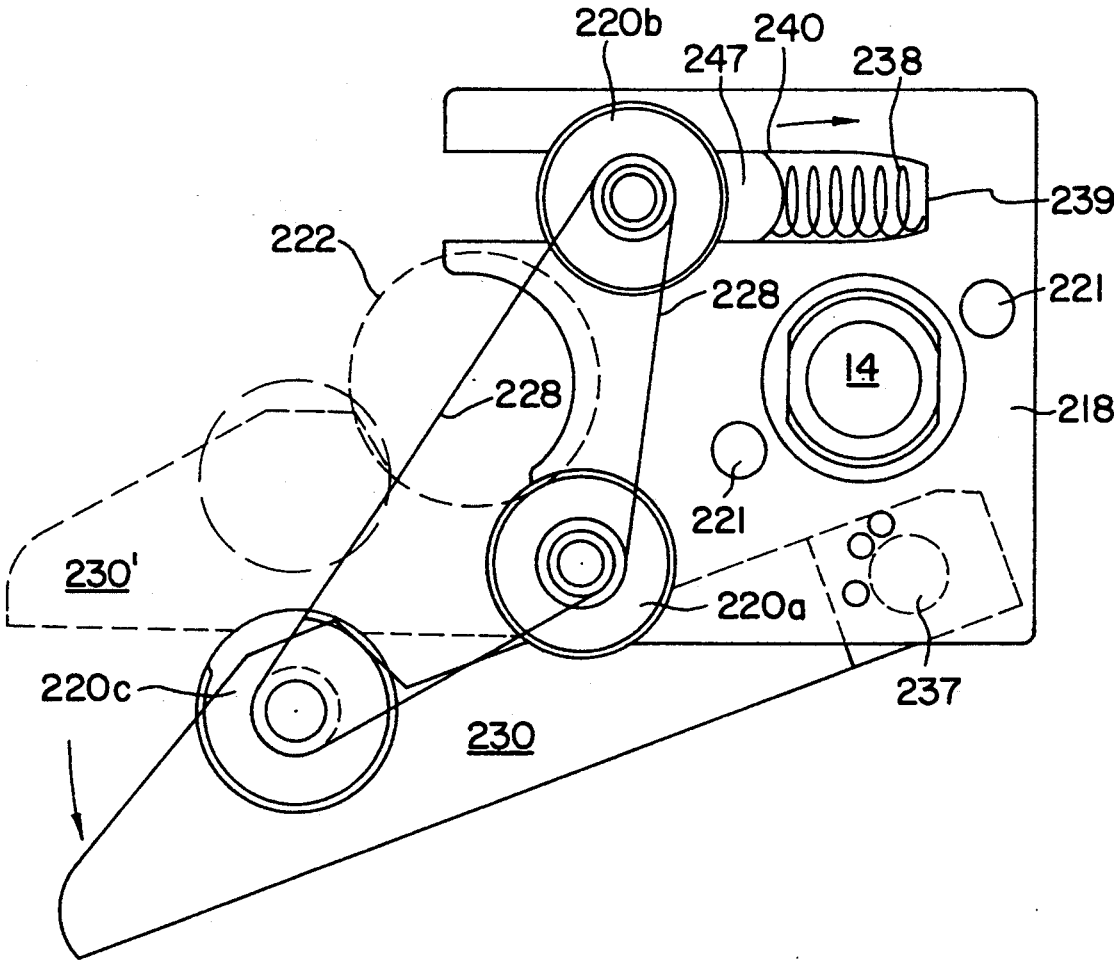
FIG. 10 is an overhead view taken along line 10—10 of FIG. 9 of the bottle holder and rotating apparatus of the instant invention.

Referring to FIGS. 9 and 10 there is shown a bottle holder and rotating assembly 200 that in the preferred embodiment may be fixedly or pivotly mounted to the top of support structure 213 which is part of a bottle receiving station for transporting the PR bottle for various types of processing in each carousel. In the preferred embodiment, the workpiece is a plastic bottle or container 15 shown in FIG. 9 in an inverted position with the open ended neck 216 facing downward. As will be explained below, the bottle holder 200 may be configured to accommodate containers in a variety of sizes and configurations.

The bottle holding apparatus 200 includes a fixed support bracket 218 held to the top of support structure 213 by fluid supply column 214, and a pivotable support arm 230 both extending traversely from the support structure 213. Support bracket 218 is attached to support structure 213 by any suitable attachment device such as bolts 221 shown as phantom lines in FIG. 9. Rotatably mounted to support bracket 218 are a pair of rotatable engaging rollers **220*a* and 220*b*, both of which are shown in FIG. 10. In the preferred embodiment, each rotatable engaging roller 220*a* and 220*b* is a cylinder and is circumferentially configured at a first end 223*a* with an indent or groove 225*a* that is complementary to a surface of the bottle and particularly, its neck ring 222. For other applications, the surface of each rotatable engaging roller may be configured differently to enable engagement with a bottle or workpiece having a different surface configuration. Rotatable engaging rollers 220*a* and 220*b* may also be spaced at different distances to accommodate workpieces or bottles 15** of various widths and sizes.

Configured at the other end **227*a* of each rotatable engaging roller 220*a,b* is a groove 226*a* for engaging a drive belt 228. Drive belt 228 is a flexible rubber belt in the preferred embodiment and is conformed around each roller 220*a,b* to impart rotational motion to the same when driven by a drive means 245 shown in FIGS. 4 and 11** and explained in detail below.

Bottle holder and rotating apparatus 200 includes a pivotable support arm 230 having a rotatable engaging roller **220*c* mounted thereon. Support arm 230 is located below support bracket 218 in the preferred embodiment and, as illustrated in FIG. 9, is separated therefrom by a biasing mechanism such as spring 232. Biasing mechanism 232 normally biases support arm 230 into an engaged position with the workpiece or bottle 15. PRB or bottle 15 is thus engaged at three points by rollers 220***a,b* and rotatable engaging roller 220*c* mounted on support arm 230. The bottle engaging position is indicated by the broken lines of support arm 230' shown in FIG. 10. When the bottle holding apparatus 200 is opened by cam means 265 shown in FIG. 12, support arm 230 will be pivoted about shaft 237 in the direction indicated by the arrow in FIG. 10. When pivoted in this position, the support bracket 218 and support arm 230 are angled apart to either permit positioning of the neck ring 222 of any bottle 15 between the grooves 225*a,b,c* of each rotatable engaging roller 220*a,b,c* prior to engagement thereof, or to permit the release of the bottle 15 from the bottle holder 200.

Rotatably mounted on support arm 230 is rotatable engagement roller 220*c* which is also configured at an end 223*c* with an indent or groove 225*c* that is complimentary to and for engaging neck ring 222 of bottle 15. In the preferred embodiment, the grooves 225*a,b,c* of rotatable engagable rollers 220*a,b,c* are horizontally coplanar to mate with neck ring 222 and to hold bottle 15 in an upright position (FIG. 9). The rollers having indents or grooves 225*a,b,c* may also be disposed in an angled plane relative to fixed support bracket 218. This configuration would permit holding and rotating of the bottle 15 in an inclined position.

Configured at an edge of rotatable engaging roller 220*c* is groove 226*c* for engaging drive belt 228. In the preferred embodiment, rotatable roller 220*c* is also provided with a belt sprocket 235 which is driven by an elongated timing belt 245 which is mounted on sprockets 245, 248 and driven by an external drive motor 193 (see FIG. 4) via a shaft 245(*a*).

Figure 11:
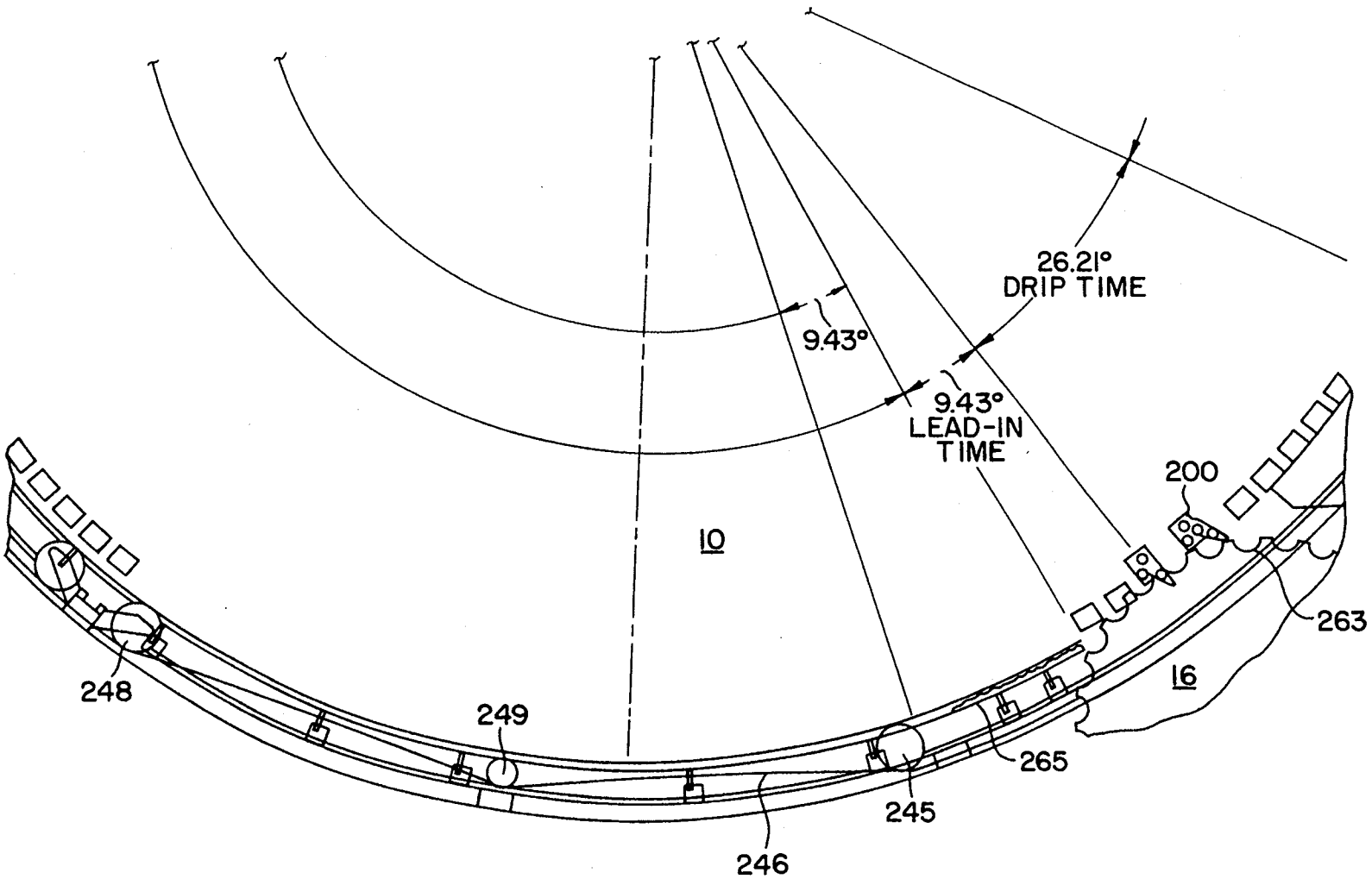
FIG. 11 is an overhead view of a portion of the wash carousel of the high-speed bottle washing machine having a motor drive means for imparting rotation to a bottle held by the bottle holder and rotating apparatus of the present invention.

FIG. 11 illustrates in detail the drive sprocket 245 and belt 246 which provides rotational motion to rotatable sprocket 235 and bottle engaging roller 220*c*. The drive sprocket 245 imparts rotational motion to timing belt 246 shown configured around sprocket 248 and idler 249. As illustrated, the drive belt 246 is located about the peripheral portion of each carousel, and is carried to the configuration of the carousel by the plurality of engaging sprockets 235 mounted on each of the bottle engaging stations. There are a plurality of drive motors 193, sprocket 245 and drive belts 246 arranged around the circumference or perimeters of each of the carousels to provide rotational motion for the bottles mounted in each of the bottle receiving stations.

Figure 12:
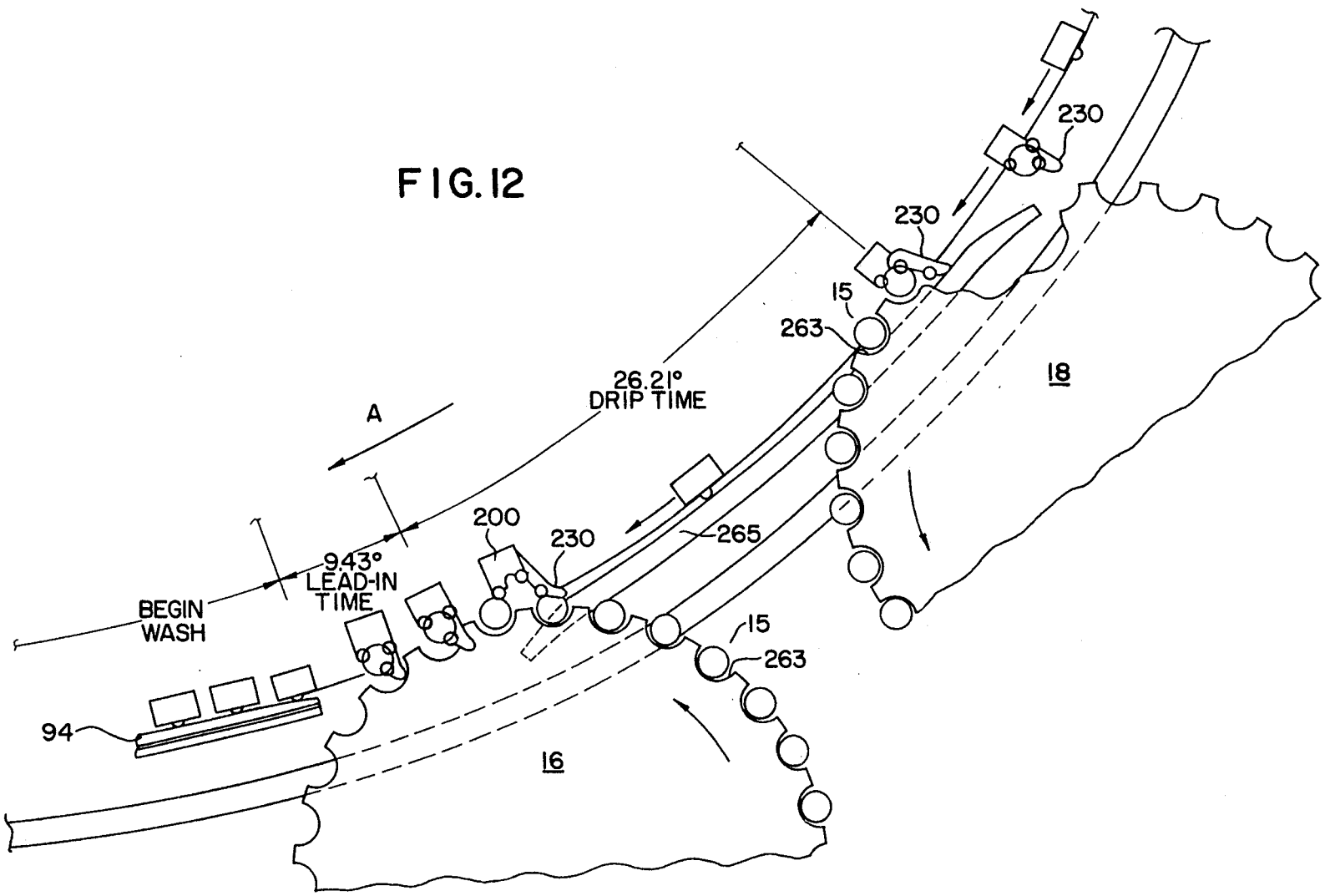
FIG. 12 is a detailed view of a section of the wash carousel illustrating the transfer of bottles to and from respective bottle holder and rotating apparatuses of the present invention.

FIG. 12 shows a bottle 15 being transferred from infeed starwheel 16 to the openly biased bottle holder and rotating assembly 200. The cam means 265 pivots the pivotal support arm 230 of the bottle holding and rotating assembly 200 to enable engagement of the bottle in the manner described above. As the bottle holding and rotating device travels in the direction shown by the arrow A in FIG. 12, the timing belt 246 engages the sprocket 235 of each bottle engaging roller 220*c*. The drive sprocket 245 is driven to provide rotation of the timing belt 246 and consequently, bottle engaging roller 220*c*. The rotational motion of engaging roller 220*c* is simultaneously imparted to rotatable engaging rollers 220*a* and 220*b* due to flexible drive belt 228. When neck ring 222 of bottle 15 is engaged by grooves 225*a,b* and *c* the kinetic friction caused by rotational motion of the rotatable engaging rollers 220*a,b,c* will cause axial spinning of the bottle 15 in the opposite direction. In the preferred embodiment, the external drive motor 193 will cause rotation of the bottle at a rate anywhere from 2 to 20 r.p.m., with 12 r.p.m. preferred. Additionally, in the preferred embodiment, an idler sprocket 249 is included midway between drive motor 245 and sprocket 248 to ensure that the portion of the timing belt 246 not engaged with sprocket 235 of rotatable engaging roller 220*c* does not interfere with the movement of the timing belt 246. It should be understood that several drive means 245 are located about the periphery of each carousel so that bottle rotation may occur at a predetermined number of locations along its traversal about the carousel for as long a duration as required.

Figures 1, 13A:
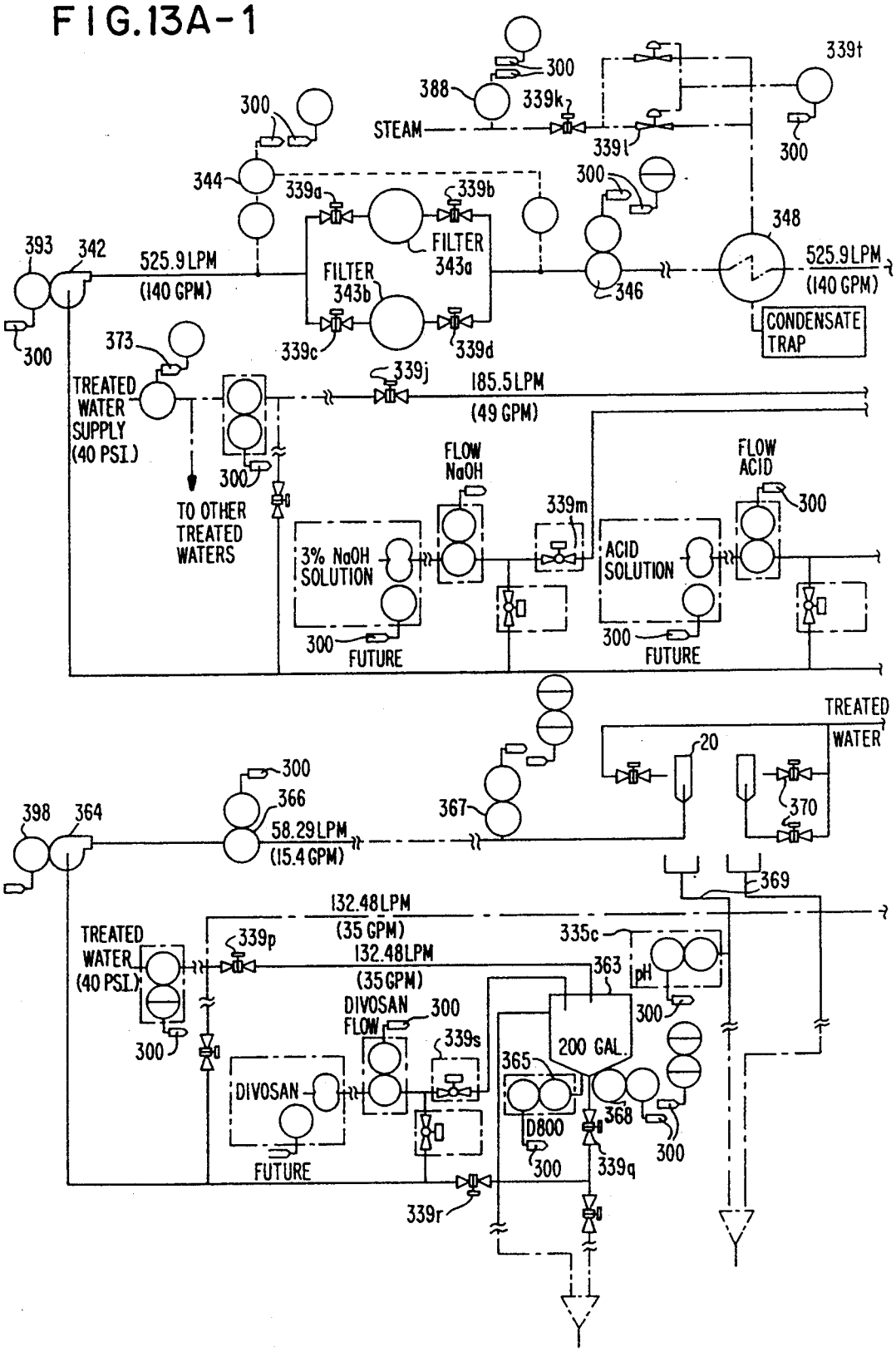
Figures 2, 13A:
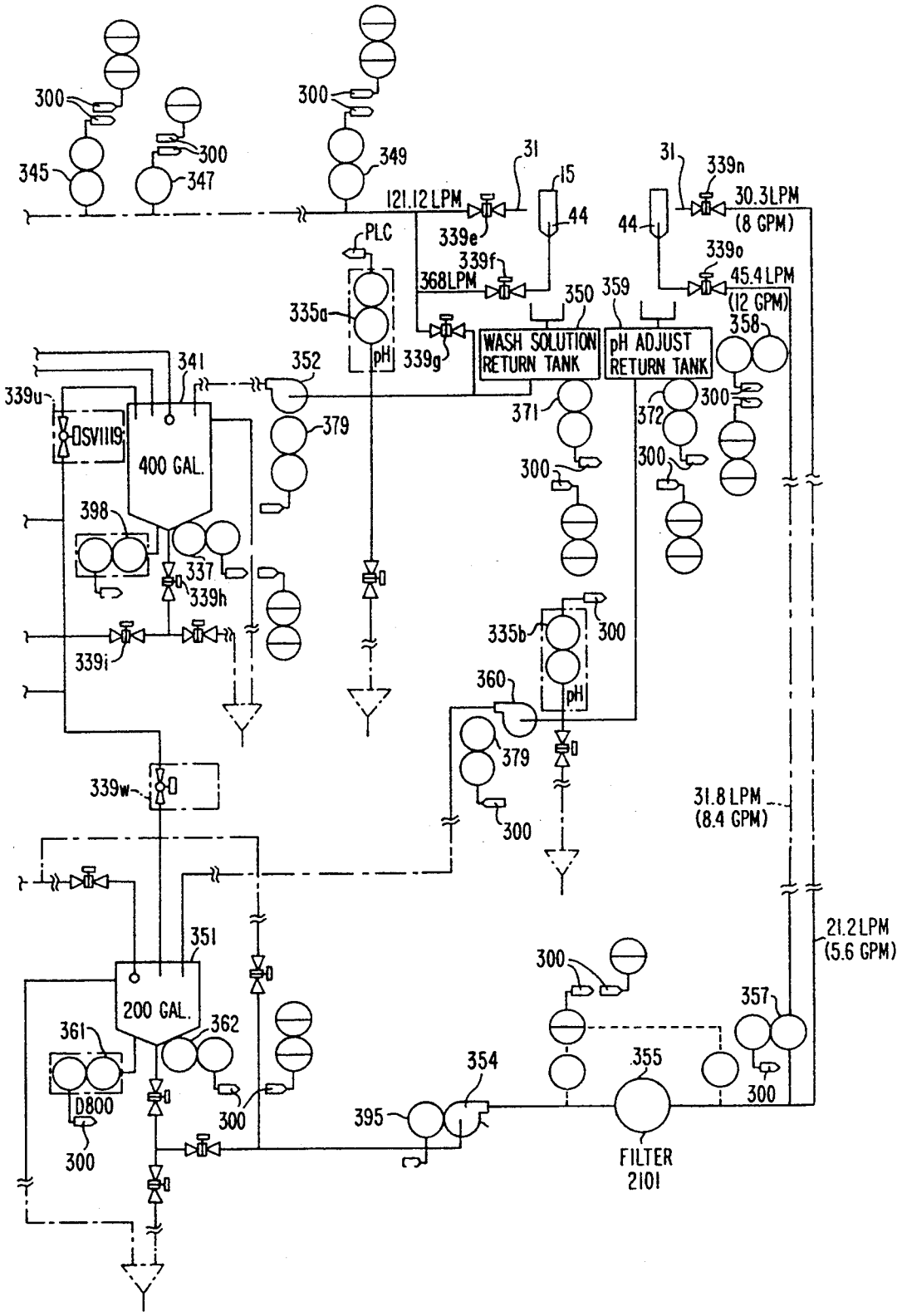
Figures 13B, 13C, 13D, 13E:
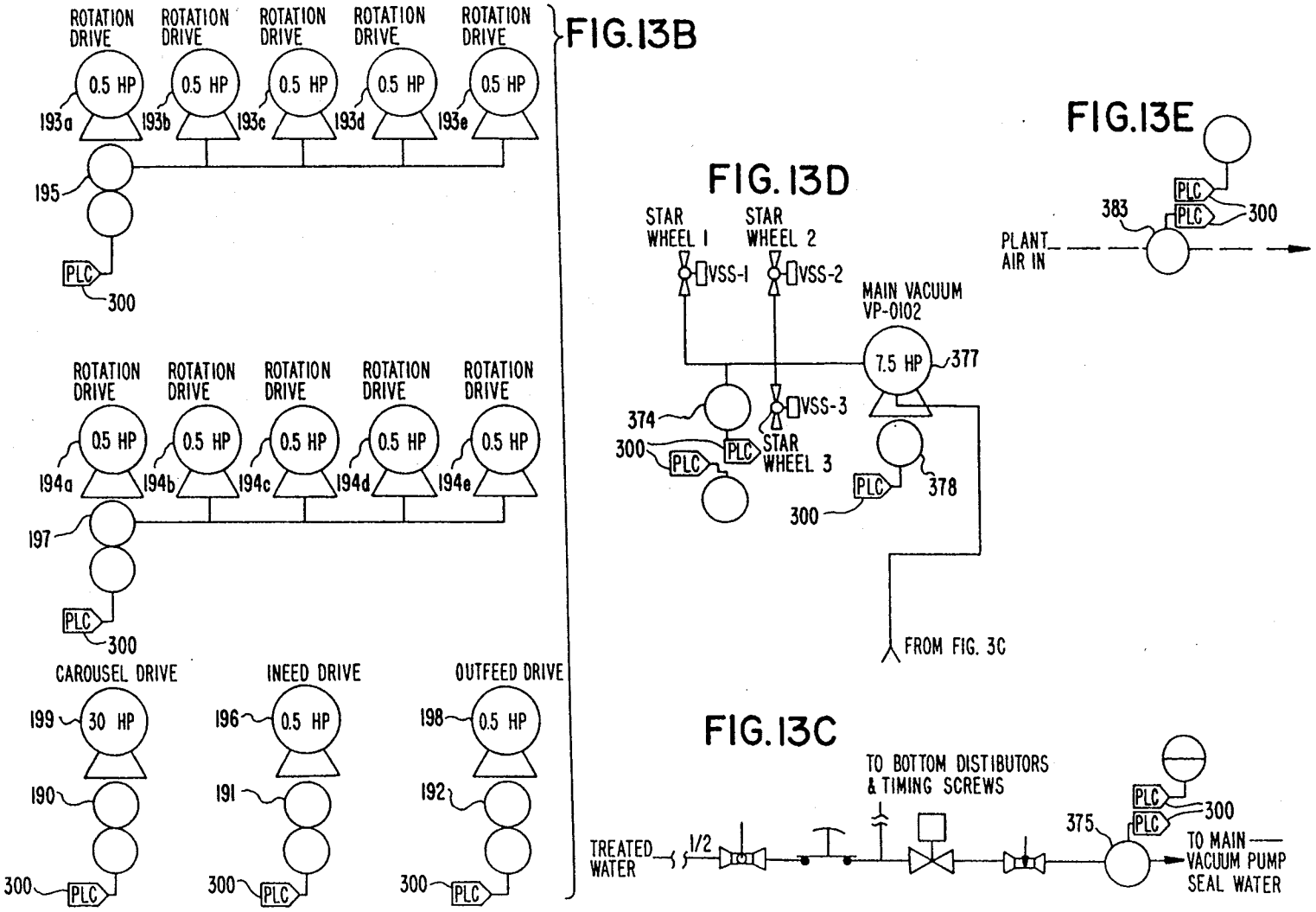

As shown in FIG. 13*b* and described in detail below, the operator may set or adjust the speeds of the various drive motors and variable frequency pumps. FIG. 13*b* illustrates a bank of five rotation drive motors 193*a*–193*e*, of preferably 0.5 HP each, which are parts of the drive means which drives the bottle spinning belts 246 for the wash carousel 10. Another bank of five rotation drive motors of 0.5 HP each 194*a*–194*e* drive the bottle spinning belts in the sanitize carousel 20.

As shown in FIG. 10, support bracket 218 is provided with an impact absorbing mechanism 240 that comprises a movable bottle engaging roller 220*b* that is mounted on a reciprocating follower 247. The follower 247 is biased outwardly by a spring 238 fixed at one end 239 to support bracket 218. This absorbing mechanism will allow horizontal translation of rotatable engaging roller 220*b* and follower means 247 when a bottle is received within the rollers and the pivot arm 230 is released by cam 265, thereby enabling engagement of the bottle neck ring 222 within grooves 225*a,b,c*. The spring 238 will be compressed and will provide a natural restoring force to return the follower means 247 and rotatable engaging roller 220*b* to its natural position shown in FIG. 10. Allowing translational movement of rotatable engaging roller 220*b* in the direction of the arrow shown in FIG. 10 will minimize the forces applied to the neck 216 and neck ring 222 of the bottle 15 either when the bottle or workpiece has a surface irregularity or protrusion, or when the rotatable rollers 220*a,b,c* engage the bottle 15 after the support arm 230 is released back to its normal position. In essence, the impact absorbing mechanism decrease the likelihood of stress crack failures in the bottle.

In the preferred embodiment, the workpiece and bottle holding and rotating apparatus 200 are configured to hold and rotate a returnable and refillable polyethylene terephthalate plastic bottle of any size and volume as shown in FIGS. 5(*a*)–5(*d*). Preferably, a plurality of bottle holding and rotating apparatuses are disposed about the circumferential portion of each carousel 10 and 20 of the rotary washer spraying system shown generally in FIG. 1, although they may also be disposed in an in-line washer spraying system.

FIG. 12 also illustrates in greater detail infeed starwheel 16 and transfer starwheel 18 which are provided with a suction grip in each pocket 263. In operation, a plurality of inverted bottles 15 are gripped by grip pockets 263 of starwheel 16 that are rotating in the direction shown by the arrows in FIG. 12, and are each successively transferred to a respective bottle receiving station and rotating assembly 200 located at the periphery of carousel 10. In the preferred embodiment, the high speed bottle washing machine can accomplish approximately 480 transfers per minute. To accomplish a transfer, support arm 230 is biased outwardly by external cam 265 to open the drive rollers to enable engagement with an appropriately registered bottle 15 as described above. Once the bottle 15 is rotatably engaged by the bottle holder 200 in the manner described above, the bottle may be subject to various types of processing for e.g., internal and external washing, drying, or the like.

As shown in FIG. 12, after a complete traversal about wash carousel 10, the support arm 230 is biased by externally located cam means 265 at the appropriate moment open the rotatable bottle engager rollers and release bottle 15 into the grip pocket 263 of rotating transfer starwheel 18 to convey the bottle 15 or inspection or further processing.

Spray Nozzle Assembly

Figure 14:
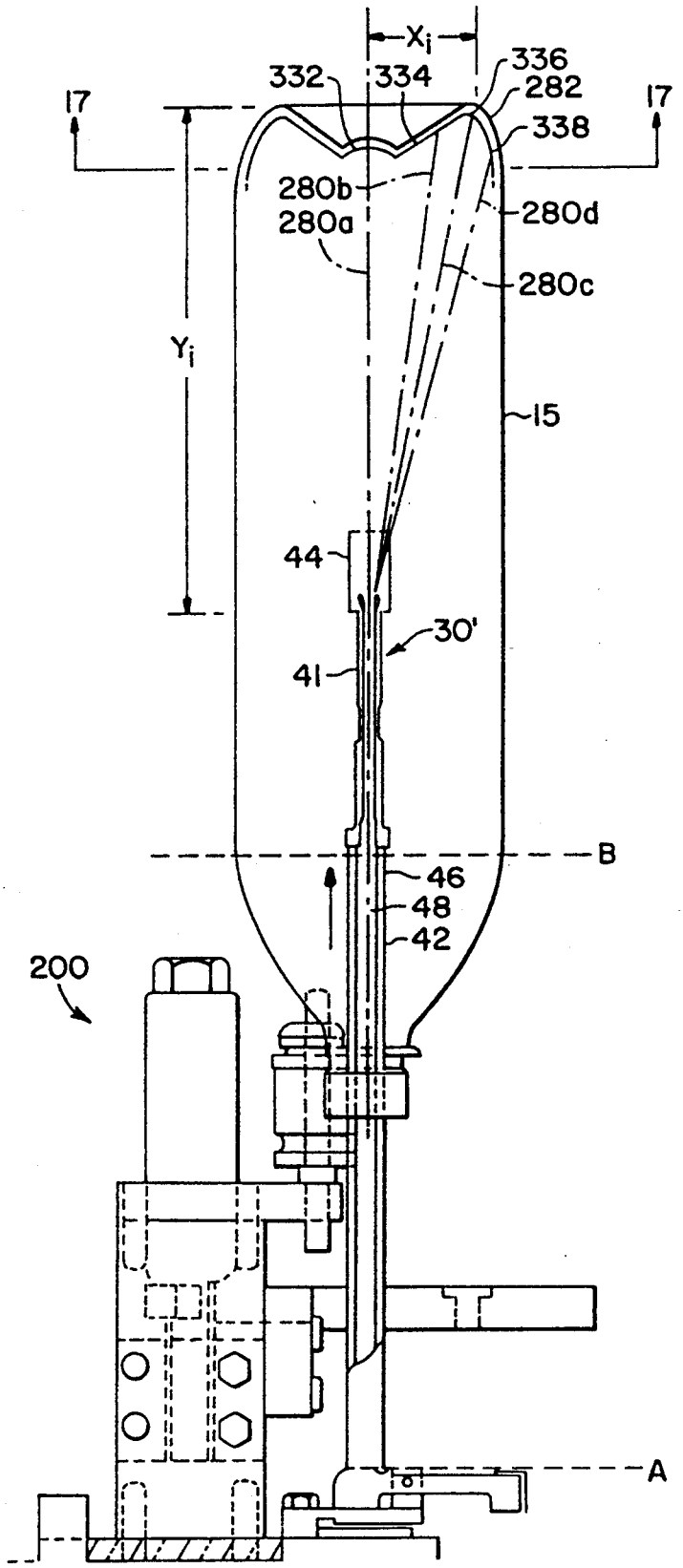
FIG. 14 is a view of the spray nozzle assembly shown inserted in a 2.0 liter bottle and discharging pressurized fluid therein.

FIG. 14 illustrates the spray nozzle assembly 301 comprising a spray nozzle body 44 and fluid driven lance 42 that is disposed within an inverted 1.5 liter bottle 15. As mentioned above, bottle 15 is a returnable/refillable blow-molded plastic bottle made of homopolymer polyethylene terephthalate or copolymers thereof and preferably may range in size from 0.5 liter to 2 liters as shown in FIGS. 5(*a*)–5(*d*), with a 1.5 liter bottle depicted in FIG. 14 for description purposes. Spray nozzle body 44 preferably cylindrical shaped and is preferably formed of stainless steel because of its ability to withstand the detergents and chemicals present in the cleaning solution used in this environment.

As shown in FIG. 14, jets of pressurized cleaning fluid 280*a–d* are discharged in focused and precise paths from the orifices in the spray nozzle body 44 and directed at the internal surface of the base region 282 of the 1.5 liter bottle 15. For clarity, FIG. 14 shows all discharged sprays exiting at only one side of nozzle 44 but, as will be explained in greater detail, the discharge orifices are arranged around the top of the nozzle and jets are also discharged from the other side of nozzle body 44 and directed at the other side of the base region 282. In the preferred embodiment, the cleaning fluid is a hot alkaline solution such as NaOH, having wetting agents and suspension compounds therein.

Figure 15C:
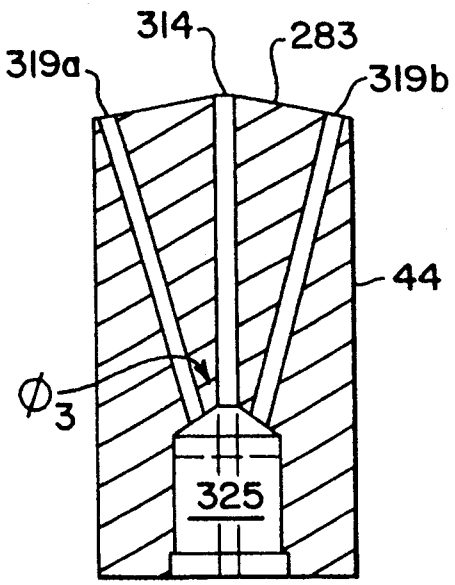
FIG. 15(*a*) is a cutaway view of the nozzle body taken along line 15*a*—15*a* of FIG. 16.
Figure 15B:
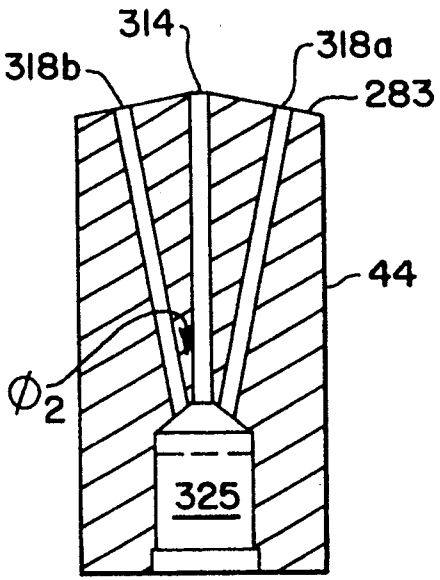
Figure 15A:
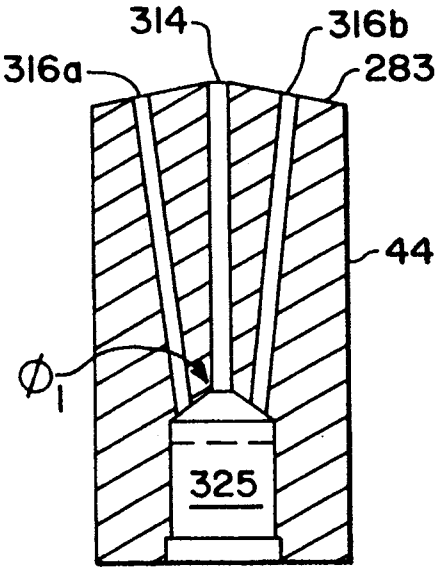
Figure 16:
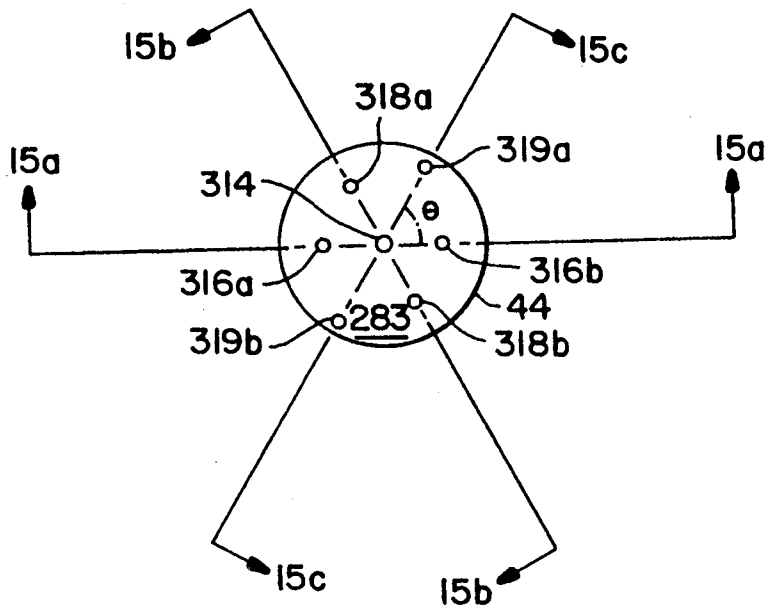
FIG. 16 is an overhead view of the nozzle body showing the staggered locations of the discharge orifices of the spray nozzle assembly.

FIG. 16 shows the top view of the surface 283 of nozzle body 44 of the instant invention. As can be seen, there is a central orifice 314, a first pair of orifices 316*a,b* located along the broken line labelled 15*a*, a second pair of orifices 318*a,b* located along the broken line 15*b*, and a third pair of orifices 319*a,b* located along the broken line 15*c*. The central orifice 314 is located equidistant between each pair of orifices 316*a,b*, 318*a,b* and 319*a,b*. Each consecutive orifice, e.g., 316*b* and 319*a*, is radially spaced $\pi/3$ radians or 60° from the prior orifice as shown by the angle $\Theta$ in FIG. 16. As can be seen, the locations of each consecutive orifice is staggered and not concentric relative to the central orifice 314. As viewed in FIGS. 15*a,b*, and *c*, the surface 283 of nozzle body 44 is conical in shape; the central orifice 314 being located at the apex of the surface 283.

FIGS. 15*a*, *b* and *c* show detailed cut-away views of the nozzle body 44 taken along the corresponding lines 15*a*, *b* and *c* of FIG. 16. FIG. 15*a* shows the nozzle body 44 having a wide centralized bore 325 that is screw threaded for attachment to various positioning devices such as the fluid driven lance 42 shown in FIG. 14. Two elongated microbores extend from the centralized bore 325 to form the two orifices 316*a,b* taken along line 15*a* of FIG. 16. A third elongated microbore extends from centralized bore 325 to form the orifice 314 of nozzle body 44. The elongated microbore 314 is common to all three views of nozzle body 44 respectively illustrated in FIGS. 15*a*, *b* and *c*, and is shown central and vertically axial therein.

Likewise, in FIG. 15*b*, two elongated microbores extend from the centralized bore 325 to form the two orifices 318*a,b* located along line 15*b* of FIG. 16. In FIG. 15*c*, two elongated microbores extend from the centralized bore 325 to form the two orifices 319*a,b* located on line 15*c* of FIG. 16. The microbores and their corresponding orifices described hereinabove are specially designed to enable the discharge of very sharp and well focused fluid jets. In the preferred embodiment, each elongated bore and corresponding orifice has a diameter of 0.4 mm to 0.8 mm with 0.6 mm being preferred. Because of the elongated nature of the microbores, they are machined by electron discharge machining.

Additionally, in the preferred embodiment, the ratio of the length of each elongated microbore to the diameter of each microbore ranges from about 20:1 to 28:1. Preferably, the length of each microbore is about 16.0 mm and the diameter of each microbore is approximately 0.65 mm resulting in a length to diameter ratio of approximately 25:1. Ratios of microbore length to microbore diameter in this range ensures that the fluid dynamics of the jet are well aligned in each microbore prior to discharge and that the fluid jets exiting each orifice exit in sharp, well-focused paths. The fluid jets which exit each orifice will keep their shape throughout its trajectory and will impinge upon the inner bottle surfaces with essentially the same mean width and with little degradation in force from the time of discharge. This is essential for high-speed cleaning required of the automated washer spraying systems of the present invention. Too many orifices discharging an excessive amount of fluid will create excessive deflections at the inner bottle surfaces as they impinge upon each other thus increasing interference and disrupting effective cleaning action. Furthermore, orifices having larger diameter will cause extraneous discharge that may interfere or collide with other fluid discharge paths, decreasing the effectiveness of the mechanical cleansing.

The microbores have been sized to provide adequate fluid delivery and impact at a operating pressure of 20 to 80 p.s.i. in the nozzle supply line. While other pressures and microdiameters could be used, the foregoing range is commonly available, with the most prevalent operating pressure being 40 p.s.i.

In FIG. 15*a*, the elongated microbores forming orifices 316*a* and 316*b* are acutely angled relative to the microbore forming orifice 314. In the preferred embodiment, the angle $\phi_1$ formed between elongated microbores 316*a* (316*b*) and central microbore 314 is approximately 7° (±10′) as shown in FIG. 15*a*. In FIG. 15*b*, elongated microbores 318*a* and 318*b* are similarly acutely angled relative to the central microbore 314 with the angle $\phi_2$ formed between the elongated microbores 318*b* (318*a*) and central microbore 314 is approximately 11° (±10′). Likewise, in FIG. 15*c*, the angle $\phi_3$ formed between the elongated microbores 319*a* (319*b*) and central microbore 314 is 15° (±10′). It should be understood that slight variations of the acute angles formed between the elongated microbores and the central microbore may exist depending upon the size and configuration of the bottle 15. For instance, a nozzle body 44 for spraying the internal bottom surface of a 2.0 liter bottle would have elongated microbores forming acute angles of $\phi_1=6°\pm(10^1)$, $\phi_2=9°\pm(10^1)$, and $\phi_3=14°\pm(10^1)$ relative to the central elongated microbore 314.

To maintain effective and maximum mechanical cleaning of the bottom interior surface 282 of the bottle, the locations and inter-relationship of the locations of the orifices 314, 316*a,b*, 318*a,b* and 319*a,b* and the location of the nozzle body 44 within the bottle 15 are critical.

The cleansing operation of the nozzle spray assembly will now be described with respect to FIG. 14, where it can be seen that bottle 15 is held in an inverted position by the bottle holder and rotating assembly described above. The bottle holder and rotating assembly 200 is configured so that the open neck portion 216 is unobstructed to permit easy insertion of the nozzle spray assembly 10. The lance 42 is designed to travel a predetermined distance in the direction indicated by the arrow in FIG. 14 to the position illustrated within the confines of bottle 15.

Simultaneous with the insertion of the spray nozzle assembly 301 within bottle 15, the bottle 15 is rotatably driven by the bottle holder and rotating assembly 200. Spray jets 280*a–d* of cleaning fluid are then discharged from the nozzle body 15 at each orifice at a pressure of 40 p.s.i. The impinging spray jets 280*a–d* in combination with the rotation of the bottle 15 the amount of fluid flow through each nozzle, and the pressure, results in an effective cleaning of the inner bottom surface 282.

Figure 17:
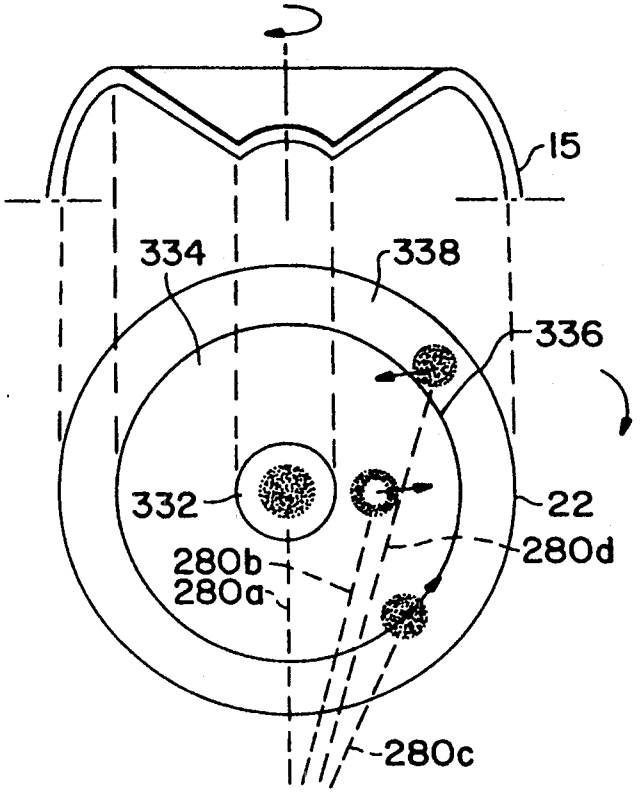
FIG. 17 is a view of the fluid jets impinging the base region of the bottle as taken along line 17—17 of FIG. 14.

The staggered locations of points where four of the spray jets 280*a–d* impinge upon the bottom surface of the bottle is illustratively shown in FIG. 17. As shown therein, the fluid spray jet 280*a* discharged from the central orifice 314 of the nozzle body 44 is directed to impinge the central base region 332 of the bottle 15. The fluid spray jet 280*b* is directed to impinge the upwardly sloping region 334 of the base 282 adjacent to the central region 332 and acts to peel any soils thereon outwardly towards the annular base groove 336. As illustrated in FIG. 17, the base region 334 of the bottle is the sloping portion of a conically recessed base or champagne type base. The fluid spray jet 280*c* is directed to impinge the annular groove region 336 of the base 282. As FIG. 17 illustrates, annular groove region 336 corresponds to the annular seating ring where the recessed portion of the base meets the semi-spherical sidewall 338. Fluid spray jet 280*d* is directed to impinge the interior sidewall 338 of the base and acts to peel any soils thereon from the outside in. It is understood that the opposite side of the base 282 is also subject to fluid spray jets that emanate from the other orifices 316*a*, 318*a* and 319*a* and that fluid is discharged simultaneously from each orifice of nozzle body 44.

As previously mentioned, the rotation of bottle 15, preferably in the counterclockwise direction shown in FIG. 17, maximizes the mechanical cleansing of the inner surface 282 of the bottle because impinging pressurized spray jets 280*a–d* act to peel off layers of debris on the inner surface of the bottle as the bottle rotates. In addition, the staggered impingement locations enables maximum cleansing while minimizing interference caused by the deflection of one spray jet of the bottle wall and into the path of another spray jet. For instance, as FIG. 17 illustrates, the fluid spray jet 280*b* impinging upon region 334 of the base peels off debris in the direction indicated by the arrow and is deflected toward the base region 336 which is itself subject to spray jet 280*c* discharged from orifice 318*b*. However, the circumferentially spaced apart relation of the impinging jets 280*b* and 280*c* as determined by discharge orifices 316*b* and 318*b* of nozzle body 44 is such that the deflection of fluid spray jet 280*b* and any peeled off debris will not appreciably interfere with the flow of fluid spray jet 280*c*. Likewise, the spray jet 280*d* impinging upon the inner surface of the interior sidewall 338 peels off debris in the direction indicated by the arrow and is again deflected toward the base region 336. The circumferentially spaced apart relation of the impinging jets 280*d* and 280*c* as determined by discharge orifices 316*b* and 319*a* of nozzle body 44 is such that the deflections of fluid spray 280*d* and peeled off debris will not interfere with the flow of fluid jet 280*c*. The combined mechanical and chemical cleaning enables the cleansing of the bottle in 15 to 20 seconds, as opposed to approximately 12 minutes in a conventional soak tank using the same chemical cleaning agent.

The spray nozzle assembly 301 is adaptable for spraying the internal surface of various sized bottles. To ensure the directional accuracy of the spray jets 280*a–d*, while keeping the fluid pressure constant at 40 p.s.i., a lance extender 41 may be connected between the spray nozzle 44 and the lance 42 as shown in FIG. 14. Lance extenders 41 of different lengths may be connected depending upon the size of the bottle to be washed. For instance, to clean a 2.0 liter bottle a shorter lance supporting the nozzle body 44 is used to ensure that the spray jets 280*a–d* are directed to the same internal bottom surfaces 332, 334, 336 and 338 as in the 1.5 liter bottle of FIG. 14.

The size of the lance extender 41 is determined by the size of the bottle. As shown in FIG. 14, the distance Y from the nozzle body 44 to the bottom surface of the bottle is determined according to equation (1), $$Y=\arctan \phi_i(X_i) \quad (1)$$

where $X_i$ is the horizontal distance from the center bottom of the bottle to the point where one of the spray jets impinges the bottom surface of the bottle, or would impinge the bottom surface of the bottle but for the sidewall 338 or recessed portion of the bottom interior and $\phi_i$ is the angle formed between the central vertical axis of the bottle and the spray jet impinging upon the bottom surface of the bottle a distance $X_i$ from the bottom center.

Control System

The physical layout of the high-speed bottle washing machine is illustrated in FIGS. 13*a–13d* which shows all the system piping and instrumentation. As heretofore mentioned, the PRB is carried along the wash carousel 10 during the washing cycle. Wash solution fluid is pumped by fixed frequency pump 342 from a wash surge/supply tank 341 through one of two parallel mounted filters 343*a,b*, through a flow monitoring element 346, shell and tube heat exchanger 348, temperature sensing element 345, overtemp switch 347, pressure element 349, and valves 339*e*, 339*f*, and 339*g* which provide for diversion of fluid flow when the wash carousel 10 is idling. As shown in FIGS. 13A-1 and 13A-2, all of the enumerated system components are connected to the Programmable Logic Controller (PLC) 300 in a conventional manner for monitoring and controlling the system processes. To simplify the illustration, a common PLC symbol 300 has been used throughout FIGS. 13*a–e* to denote the connection from each device controlled by the PLC to the PLC. It is understood, however, that there is only a single PLC 300 for the control system. The fluid is supplied to the external bottle spray header and external nozzles 31, and to the wash carousel rotary union 28*a*, wash solution supply annulus 321, and finally through a valve and manifold 40 to the lance and interior spray nozzles 44. In the preferred embodiment, wash surge/supply tank 341 has a 400 gallon capacity, and contains a 3% NaOH alkaline solution. In the preferred embodiment, Divobrite®, a commercially available alkaline wash solution having 3% NaOH and other wetting and suspension compounds, is used. Divobrite®, is available commercially from Diversey Corporation, Wyandott, Mich. and has a pH of about 12.5. Additionally, the wash surge/supply tank 341 is provided with PLC connected pH/conductivity sensor 398 and fluid level sensor 337 for monitoring respectively, the pH and fluid level in the tank. In the preferred embodiment, all pH and conductivity sensors described herein are commercially available. Likewise, all fluid level sensors are commercially available.

Temperature sensing element 345 is provided to ensure that the wash solution remains at a temperature of 140 degrees that will accomplish maximum cleansing without causing damage to the PR bottle or premature shrinkage thereof. It should be noted that in the present invention the PRB bottles receive a spray cleaning of 15 to 20 seconds with the 140° NaOH, where as conventional processes soak the PRB in hot NaOH for 4 to 12 minutes. This provides a significant reduction in the heat induced shrinkage of the PRB.

A pressure differential element 344 examines the pressure on the inlet side of the dual filter 343*a,b* and compares that with the pressure on the outlet side of that filter. If the difference is too great, the filter is assumed to be near saturation, and valves 339*a* and 339*b* are simultaneously operated to shut off the first parallel filter 343*a* and to open valves 339*c* and 339*d* and the second parallel filter 343*b*, thus supplying a fresh filter without having to shut down the bottle washing operation.

As the PR bottles are being washed in the wash carousel 10, the spent wash solution collection trough 36 and is gravitated to and collected by wash solution return tank 350 for recirculation. From wash return tank 350, the spent wash solution is pumped back via variable frequency pump 352 to wash surge/supply tank 341 to complete the wash recirculation circuit. Wash solution return tank 350 is provided with a fluid level sensor 371 and pH sensor 335*a* both of which are connected to the PLC for monitoring respectively the level of the recovered wash solution and its pH concentration. Fluid levels controls are provided for all solution carrying tanks to provide maximum efficiencies and economies against overusing the respective solutions.

As shown in FIG. 13A-2, the neutralizing rinse circuit for neutralizing the PR bottles after the wash treatment comprises a recirculated neutralizer surge/supply tank 351 for supplying a pH neutralizing solution to the wash carousel 10, a fluid pump 354 for pumping neutralizing solution from the rinse neutralizer surge/supply tank 351 to the wash carousel 10, through filter 355, flow element 357 for monitoring the fluid flow rate, and pressure element 358 for monitoring the pressure of the neutralizing solution supplied to the internal spray nozzles 44 and external spray nozzles 31. In the preferred embodiment, recirculated neutralizer surge/supply tank 351 has a 200 gallon capacity and contains an acidic solution. In the preferred embodiment, Sentol®, a commercially available acidic solution having a pH of about 2.5, is used. Sentol®, is also available commercially from Diversey Corporation, Wyandott, Mich. and is supplied to the neutralizer surge/supply tank 351 via flow valve 339*w*. Additionally, the neutralizer tank 351 is provided with a pH sensor 361 and a fluid level sensor 362 for monitoring respectively, the pH concentration and the fluid level in the tank. As seen in FIG. 13A-2, all of these system components are connected to the PLC in a conventional manner for monitoring the system processes.

In the high speed bottle washing system, it is desirable that the bottles are neutralized by an acidic solution. The purpose of the neutralizing agent is to ameliorate the alkalinity of the bottle from the proceeding wash cycle because the efficacy of the sanitizer would be reduced if a bottle is transferred to the sanitizer carousel in a highly alkaline state. Hence, control of the pH concentration of the neutralizing solution is necessary.

As the PR bottles are being neutralized in the wash carousel 10, the spent neutralizing solution is gravitated to and collected by neutralizer collection tank 359. From neutralizer collection tank 359, the spent neutralizing solution is pumped back via variable frequency drive pump 360 to the reuse neutralizer surge/supply tank 351. Neutralizer collection tank 359 is provided with a fluid level sensor 372 and pH sensor 335*b* both connected to the PLC for monitoring respectively, the level of the recovered neutralize solution and its pH concentration.

The flow monitoring elements 346 and 357 in both the wash and neutralizing circuits are very sensitive flow measuring devices for measuring small differences in flow rates. In the preferred embodiment, all flow measuring devices described herein are commercially available. Should a nozzle in the wash carousel be plugged, the signal rate will be lower and the suspect nozzle(s) will be flagged and the identity of the PRB station will be retained in PLC memory. That particular station or stations and more importantly, the location of the corresponding bottles, is retained in memory throughout the bottle flow sequence. Those bottles may then be rejected in subsequent bottle handling or inspection stations as being of uncertain quality.

After washing and neutralizing, the PRB is transferred to the sanitizing carousel 20 as previously described with respect to FIGS. 1 and 3. Sanitizing of the interior of the PR bottles is desirable for disinfecting the bottle before conveying the PR bottle for refilling. As illustrated in FIG. 13A-1, fresh sanitizing solution is pumped via pump 364 from a sanitizing solution supply tank 363 through a flow monitoring element 366, pressure measuring element 367 for monitoring the pressure of the sanitizing solution, and to the sanitize carousel rotary union, sanitizer supply annulus, and finally through a valve and manifold to the lance and interior spray nozzles. As mentioned above, each of the enumerated system components are connected to the PLC in a conventional manner for monitoring the system processes. Flow element 366 is a very sensitive flow measuring device that detects small differences in flow rates.

The sanitizing carousel 20 duplicates in some respects the operation of the wash carousel with different solutions, temperatures, and solution timings. In the preferred embodiment, fresh sanitizer surge/supply tank 363 has a 200 gallon capacity and contains a sanitizing solution comprising Divosan ® which is supplied to it via adjustable valve 339s. Divosan ® is a $HNO_3$ a solution containing iodine and is commercially available through and manufactured by Diversey Corporation, Wyandott, Mich. Additionally, the fresh sanitizer surge/supply tank 363 is provided with a PLC connected pH sensor 365 and a fluid level sensor 368 for respectively monitoring the pH concentration and the fluid level in the tank 363.

After sanitizing the interior of each PR bottle, both the internal and external surfaces are subject to a terminal rinse of treated water to remove any residual sanitizer from the preceding sanitizing step. As shown in FIGS. 13A-1 and 13A-2, treated water at a pressure of 40 psi is caused to flow through a series of valves 370 at the sanitize carousel 20, where the internal and external PRB surfaces are rinsed. All of the terminal rinse water (as well as spent sanitizer) in the sanitizer carousel collects in separate sanitize drain troughs 34 and gravity returns it to a drain tank. Drain troughs 34 are provided with pH sensor 335c for measuring the pH concentration of the spent sanitize solution.

During the PR bottle flow sequence described hereinabove, the control system PLC maintains, manages, and controls each individual process e.g., carousel rotational speed, infeed/outfeed conveyors, bottle rotation drive motor speeds etc. Additionally, the control system PLC monitors and controls pumps, valves, solenoids and the starter motors required by the process. The control system PLC also provides for monitoring and adjusting fluid levels, alkalinity/acidity concentrations, and temperature of the wash solution.

For example, the high speed bottle washing machine will perform real time monitoring of the utility components include such as the air pressure system, the steam pressure system, and water pressure system. Particularly, a real time monitoring that the respective pressures are within their desired ranges will be performed. As shown in FIG. 13e, pressure sensor element 383 connected to the control system PLC will monitor the plant air pressure that supplies the static air for retracting the fluid lance 42. In FIG. 13A-1, steam pressure sensor element 388 monitors the steam pressure supplied to the system. In addition, water pressure sensor 373 connected to the control system PLC will monitor the pressure of the treated water supplied to the system. Whenever any of these respective utility pressures are out of range, a stop condition exists and an alarm signal will be generated and the diagnostics will stop. An operator at that point may take appropriate action to rectify any problems in the utility systems.

Similarly, a real time monitoring of the system support components is also included. These system support checks the main vacuum, distributor and vacuum seal water, and exhaust fans. As shown in FIG. 13d, main vacuum pump 377 which creates the main vacuum for the suction grips of starwheels 16,18, and 22, is provided with a pressure sensor 374 to monitor the main vacuum manifold. Similarly, as shown in FIG. 13c, the flow sensor 375 will check that the vacuum pump seal water is supplied to the main vacuum pump 377. If these components are not operational as determined by the control system PLC, the diagnostics will stop and an appropriate message displayed for operator intervention.

A safety systems monitor check is also performed. This diagnostic will check that the wash doors, one of which is shown as 35 in FIG. 4, sanitizer doors, and front deck doors are closed, secured, and in place. If these components are not present or secured, the diagnostics will stop and an appropriate message displayed for operator intervention.

Note that all of the machine process variables, e.g. motor speeds, temperature, pressures, etc. may be set by the operator or preprogrammed into the control system PLC. The process variable setpoints are the range limits for the processes to be controlled and monitored by the PLC in the system and in the preferred embodiment, absolute setpoint limits for each process is programmed in the PLC so that an operator may not set ranges above or below the setpoint limits.

When desired, the operator may set or adjust the speed process variables. The speed process variables are the speeds of the various drive motors and variable frequency pumps. In view of FIG. 13b, motor speed sensor elements 195 and 197 are hardwired to the PLC (not shown) to monitor the current operating speeds or receive instructions from the operator to automatically change the speed of the respective motor banks of five rotation drive motors 193a–193e which drive the bottle spinning belts for the wash carousel, and the bank of five rotation drive motors 194a–194e which drive the bottle spinning belts in the sanitize carousel. In other embodiments, the speed of each individual drive motor may be controlled separately to vary the rotational speed of the bottle during different fluid treatments. The speed setpoints for the 30 HP primary drive motor 199 may also be programmed in the control system PLC. Motor speed sensor element 190 connected to the PLC, monitors the rotational speed of each wash and sanitize carousel. In the preferred embodiment, each carousel rotates at a speed of 2–4 rpm. Other speed process variables to be controlled and monitored by the PLC include the drive motor speeds 196, 198 for the infeed conveyor and outfeed conveyor. Preferably, these motors are 0.5 HP each and are provided respectively with motor speed control elements 191, and 192.

The speed of the variable frequency pumps 352 and 360 of FIG. 13A-2 are also monitored by the PLC via respective connections to motor speed control sensors 378 and 379. It should be understood that if any of these drive motor or variable pump speeds fall above or below the programmed setpoints, the PLC will trigger an alarm and an appropriate message will be displayed.

The next process variable setpoints to be programmed for automatic control are the flow process variables. FIGS. 13A-1 and 13A-2 show flow elements 346, 357 and 366 are connected to the control system PLC to monitor the flow of solutions supplied to the wash and sanitize carousels. Flow element 366 monitors the flow of sanitizing solution to the sanitize carousel 20, and flow elements 346 and 357 respectively monitors the flow of wash solution and neutralizer to the wash carousel 10. When the system is running, the preferred flow rates for the sanitizer solution ranges from 35.0 L/min. to 75.0 L/min. The preferred flow rate for the wash solution ranges from 250 L/m to 750 L/m and the flow rate for neutralizer solution ranges from 25.0 L/min. to 40.0 L/min. If the flow rates of the respective solutions vary from the preset rates, an alarm condition will exist and a message will be displayed to the operator.

The setpoints for the level process variables may be programmed and these processes are continuously monitored. As shown in FIGS. 13A-1 and 13A-2, fluid level sensor elements 337, 362 and 368 provided in the system are respectively connected to the PLC to monitor the levels of the solutions in the wash, neutralizer, and sanitize tanks. Elements 371 and 372 monitor the solution levels with the recirculated wash solution return tank 350 and neutralizer collection return tank 359 respectively. When the solution levels in these tanks exceed or fall below acceptable limits, an alarm condition will exist and an appropriate message will be displayed for the operator.

The temperature process variable setpoints may also be programmed for automatic control of these process variables. As shown in FIGS. 13A-1 and 13A-2, temperature element 345 is connected to the PLC and monitors the temperature of the wash solution supplied to wash carousel 10. If the temperature of the wash solution varies from the nominal 140° F., the amount of the steam supplied to the heat exchanger 348 will be adjusted accordingly by valve 339L. Over temperature limit switch 347 is hardwired to the automatic safety shutoff valve **339*k*** which will shut off the steam and provide an alarm signal when the temperature of the wash solution exceeds 145° F.

The pressure process variable setpoints may be adjusted next for continuous monitoring of these process variables. These setpoints regulate the pressure for each of the solutions supplied to the carousels as well as the steam pressure, air pressure and treated water pressure. As shown in FIG. 13A-2, pressure transducer 349 is connected to the PLC and monitors the pressure of the wash solution supplied to the wash carousel. Likewise, pressure transducer 358 monitors the pressure of neutralizing solution supplied to the wash carousel, and pressure transducer 367 monitors the pressure of the sanitize solution supplied to the sanitize carousel 20. In the preferred embodiments, all solutions are programmed to flow under a pressure of 40 psi. As mentioned above, also connected to the PLC are pressure transducers 373, 383, and 388 that monitor respectively the system water and air pressures supplied at 40 psi, and steam pressures supplied at 65 psi. If the current values of any of the monitored pressures are out of range, an alarm condition will exist and an appropriate message displayed.

The analytical process variable setpoints may be adjusted next for continuous monitoring of these process variables. The pH/conductivity sensors 398, 361, 365 are each connected to the PLC as shown in FIGS. 13A-1 and 13A-2. The pH of the wash solution ranges from 12.0 to 13.0 and its conductivity ranges from 0–5%. The pH of the neutralizing solution ranges from 2.0 to 4.0. If the current measured pH value of any solution exceeds the programmed or nominal value the pH of that solution will accordingly be adjusted automatically. The pH of the spent wash solution is monitored by pH sensor **335*a* and the pH of the spent neutralizer and sanitizer solutions are monitored by pH sensors 335*b* and 335*c***.

RUN MODE

When the high speed bottle washing machine is running, many system operations are concurrently executed. These operations include enabling the dedicated motor drives and pumps, enabling the batch-fill routines, maintaining the proper fluid levels in the tanks and the proper pH/conductivity of the solutions, and to prove the contacts and starters.

As shown in FIGS. 13A-1 and 13A-2, the wash circuit startup includes enabling filter **343*a* and 343*b* and adjusting solution flow valves 339*a*–339*i* to enable flow of wash solution to the wash carousel 10, and enabling the flow of steam via pneumatically operated control valves 339*k*, 339L driven by current to pressure transducer 339*t* to the heat exchanger 348. Flow valve 339*m* is also adjusted to provide a flow of the NaOH solution to the fill wash surge/supply tank 341 if the level of the tank is under 20% full. Flow valve 339*j* is also adjusted to provide a flow of treated water to the fill wash surge/supply tank 341. The valves 339*n* and 339*o*** are adjusted to provide neutralize solution to the external and internal spray nozzles in the wash carousel.

In the sanitize circuit, valves **339*p*–339*r* enable the flow of sanitizing solution from the sanitizing solution supply tank 363 to the lances and spray nozzles of the sanitize carousel 20, Flow valve 339*s*** enables the flow of Divosan ® to the sanitize supply tank.

The wash startup routine also includes enabling the vacuum and conveyor motors and pumps. Main vacuum pump starter 378 shown in FIG. **13*d* is actuated as are the starters 393, 395, and 398 for the respective fluid pumps 342, 354, and 364**. Also enabled are the run infeed and run outfeed drive conveyors. While in the run mode, the real time maintenance of the solution tank fill level and pH concentrations are provided by the PLC.

To ensure the effectiveness of the high speed bottle washing machine, parallel checks are made to ensure that the PR bottles input to the infeed conveyor are synchronized with the discharge of bottles at the output conveyor. Furthermore, continuous checks are made to ensure that they both are in synchronization with the rotation of the carousels and with the speed of the downstream bottle filler. In the preferred embodiment, the carousel speeds are controlled to produce cleaned and sanitized bottles to a downstream filler at a rate of 440 bottles/min. Additionally, a check is made to ensure that the each lance and spray nozzle is synched for input to each PR bottle input.

As mentioned above, the PLC of the high-speed bottle washing machine is programmed to perform a specialized check for determining when a spray nozzle is clogged or when a spray lance carrying the spray nozzle has not been inserted in the PRB. The process implemented by the PLC tracks and retains in memory the number of any PRB station that contains a clogged spray nozzle, inoperable spray lance, or, has a bottle holder apparatus that doesn't rotate at the preferred rate of 10–12 r.p.m. The bottles carried by these tracked stations will be deemed as being of uncertain quality and ultimately rejected by a suitable rejection device 21 located at the outfeed conveyor or at a bottle inspection station mounted downstream of the washer system.

A master strobe signal and an associated counter in the PLC are both reset before the first bottle is input to the wash carousel. A count which corresponds to the PRB station number is maintained by the counter. For instance, the bottle station receiving the first PR bottle is PR bottle station number one (1), and will be identified as such throughout the bottle's conveyance. The first bottle is input to PRB station number one (1) is located at 301 as shown in FIG. 1. The counter increments by one for each bottle input until the first bottle input is discharged at the outfeed conveyor. Although all bottles to be cleaned are input to the wash carousel at position one (1), a position number is assigned for each position located about the periphery of the carousel. Therefore, when the second bottle is input at position one (1), the first bottle is located at position two (2).

When the third PRB is input, the first bottle (PRB station one) is at carousel position three (3), the second bottle (PRB station two) is at carousel position two (2), etc.

Each PRB station number also has assigned attribute registers resident in PLC memory, that stores information or data corresponding to the station attributes. In the preferred embodiment, bottle station attributes include data indicating whether the particular bottle is rotating, whether the wash and sanitize spray lances are inserted in the inverted bottles, and whether the wash and sanitize spray nozzles have been clogged. These attributes indicate that the PR bottle carried by the station is of uncertain quality and should be discarded at the output. In other embodiments, other types of attribute data may be assigned to the appropriate attribute registers.

After each transition of the master strobe, all PR bottle station attribute checks are performed at each position along the wash and sanitize carousels, and the transfer starwheels. An identification of the particular bottle station being checked is first identified. This is easily accomplished by the PLC which knows the current master strobe count (bottle number) and its position about the carousel. Then, at each identified position, a check is made to ensure that each bottle is rotating at the corresponding PRB station. Additionally, checks are performed by appropriate motion sensors or proximity sensors located at each carousel position to ensure that wash spray lances are fully extended or that the sanitizing spray lances are fully extended. If an attribute at a particular station is bad, e.g., spray lance not up, then the information will be sent to attribute registers associated with the identified station in PLC memory.

The checks for clogged spray nozzles for stations in the wash carousel and in the sanitizer carousel are likewise determined at each position in the following manner: the normal flow rate for ten (10) spray nozzles, as measured by analog flow sensors 346 and 357, is 34.5 liters/min. in the preferred embodiment. This amount corresponds to a predetermined binary number implemented as counts of an A/D converter which may be part of or connected to the flow sensor. In the preferred embodiment, a flow rate of 34.5 liters/min. corresponds to 8300 counts of the A/D converter. Since each spray nozzle passes about 0.5 liters/min., a flow rate of 10 lances with one clogged nozzle is 34 liters/min., or 7864 counts of the A/D converter. Therefore, to detect one or more plugged nozzles, the flow rate will have to be at least 436 less than the previous value.

The following example illustrates how a clogged nozzle is determined: each flow monitoring element measures flow rates for ten (10) lances at a time. If the flow rate for the first ten bottles input and conveyed to PRB positions 1–10 is normal, i.e., 8300 counts of the A/D converter, and the flow rate measured when the 11th bottle input is 436 less than the previous count, then the spray nozzle at PRB station number 11 (at position 1) must be clogged because it was previously determined that bottle 1 through 10 had no clogged nozzles. Consequently, data indicating a clogged spray nozzle will be assigned to the attribute register corresponding to PRB station number 11. The eleventh ($11^{th}$) bottle will subsequently be discharged at the output.

After the attribute checks are made, the master strobe is turned off and the next bottle is input to the next bottle station. Concurrently, the station number is incremented by 1 as is the pointer to the attribute registers in PLC memory. The master strobe is then initiated again and a check is made to determine if the last station has received a bottle, i.e., the last station number had been reached. If the last station number has not been reached, then the process is repeated PRB station attribute checks are made at all positions about the carousel until a new bottle is input to the next station. If the last station number was reached, then the first bottle input (station one) is ready for discharge at the egress starwheel and outfeed conveyor 26. A check is then made to the attribute registers associated with the bottle ready for discharge to determine if any bad attributes exist. If a bad attribute is found, then the bottle will be rejected by discharge means located in the output conveyor or at a subsequent bottle inspection station mounted downstream of the washing system. If no bad attributes are found in the attribute registers associated with the bottle to be discharged, then the bottle may be conveyed downstream for product filling. Finally, the bottle count is incremented and the process repeats itself for as long as the machine is in the run mode.

While the invention has been shown and described with respect to preferred embodiments thereof, it will be understood by those skilled in the art that the foregoing and other changes in form and details may be made therein without departing from the spirit and scope of the invention, which should be limited only by the scope of the appended claims.

We claim:

1. A high speed bottle washing machine for sequentially washing returnable bottles upon their return, prior to refilling, each said bottle having residual soiled locations on an internal surface thereof, said machine comprising:

(a) plurality of moving bottle receiving stations, each of said stations having means for sequentially receiving and means for independently gripping and rotating a respective inverted bottle received from a bottle infeed means and discharging them at a bottle outfeed means, (b) a plurality of reciprocating spray nozzles, with at least one spray nozzle moving with each bottle receiving station, said spray nozzles reciprocating from a first position below said inverted bottles, to a second position within said bottles, (c) manifold means for sequentially supplying a caustic wash fluid under pressure to each of said plurality of spray nozzles to clean said bottles by impingement of said wash fluid in a predetermined pattern at said residual soiled locations within the bottles as the bottles are rotated.

2. A high speed bottle washing machine as claimed in claim 1, said manifold means further comprising a plurality of valves for sequentially supplying at least said caustic wash fluid, and a second fluid to said spray nozzles.

3. A high speed bottle washing machine as claimed in claim 2, wherein said manifold further sequentially supplies a third fluid, with said second fluid being a acid neutralizing fluid.

4. A high speed bottle washing machine as claimed in claim 2, wherein said manifold means further includes a plurality of cams which engage said valves as said stations are moved from the bottle infeed means to the bottle outfeed means.

5. A high speed bottle washing machine as claimed in claim 2, wherein said spray nozzles include a plurality of orifices arranged in a predetermined staggered pattern to focus impinging jets of caustic wash solution against the interior of said bottles as they are rotated to physically remove and chemically dissolve any soils therein.

6. A high speed bottle washing machine as claimed in claim 1, wherein said spray nozzles include a plurality of orifices arranged in a predetermined staggered pattern to focus impinging jets of caustic wash solution against the interior of said bottles as they are rotated to physically remove and chemically dissolve any soils therein.

7. A high speed bottle washing machine as claimed in claim 6, wherein said predetermined pattern of orifices staggers the impingement of adjacent jets as the bottles are rotated to avoid interference between adjacent jets.

8. A high speed bottle washing machine as claimed in claim 7, wherein said orifices have a length to diameter ratio greater than 20 to 1 to provide focused jets of fluid.

9. A high speed bottle washing machine as claimed in claim 8, wherein said orifices have a diameter of 0.4 to 0.8 mm.

10. A high speed bottle washing machine as claimed in claim 7, wherein said predetermined pattern provides jets of wash solution that mechanically peel any soils within said bottle while simultaneously chemically dissolving the same.

11. A high speed bottle washing machine as claimed in claim 2 or 6, wherein each of said reciprocating spray nozzles further include a fluid driven lance that is reciprocated from said first position to said second position by the fluid pressure of the caustic wash fluid within said manifold means.

12. A high speed bottle washing machine as claimed in claim 11, wherein said fluid driven lance is retracted from said second position to said first position by the fluid pressure of a second fluid supplied to said manifold means.

13. A high speed bottle washing machine as claimed in claim 1, wherein said reciprocating spray nozzles further include a fluid driven lance that is reciprocated from said first position to said second position by the fluid pressure of the caustic wash fluid within said manifold means.

14. A high speed bottle washing machine as claimed in claim 2 or 6 or 13, wherein said plurality of bottle receiving stations are mounted in an endless loop between said infeed means and said outfeed means.

15. A high speed bottle washing machine as claimed in claim 1, wherein said bottle receiving stations and said reciprocating spray nozzles are mounted on said manifold means.

16. A high speed bottle washing machine as claimed in claim 1, where in said plurality of bottle receiving stations are mounted in an endless loop between said infeed means and said outfeed means.

17. A high speed bottle washing machine as claimed in claim 16, wherein said endless loop is a circular carousel, and said plurality of stations are arranged around the perimeter of said carousel.

18. A high speed bottle washing machine as claimed in claim 17, where in said machine includes a first and a second carousel, each of which provides an endless loop for said stations and said bottles.

19. A high speed bottle washing machine as claimed in claim 2 or 5 or 13 or 17, wherein said bottle infeed means is a rotating starwheel having a plurality of bottle receiving pockets defined around a perimeter thereof.

20. A high speed bottle washing machine as claimed in claim 1, wherein said machine further includes a control means for automatic operation.

21. A high speed bottle washing machine as claimed in claim 2 or 5 or 13 or 17 wherein said machine further includes a control means for automatic operation, said control means including cam means for controlling said manifold means and the reciprocation of said reciprocating spray nozzles, and electronic control means for controlling the speed of movement of said moving stations and the fluid pressure of the wash fluid supplied to said manifold means.

22. A high speed bottle washing machine as claimed in claim 21, in which said electronic control means is a programmable logic controller.

23. A high speed bottle washing machine as claimed in claim 21, wherein said machine includes means for recovering said wash fluid for continuous use, and said electronic control means includes means for adjusting the ph of said wash fluid.

24. A high speed bottle washing machine as claimed in claim 21, wherein said machine further includes means for adjusting the temperature and pressure of said wash fluid, and said temperature and pressure are automatically regulated by said control means.

25. A high speed bottle washing machine as claimed in claim 2 or 5 or 13 or 17 or 20, wherein said bottle receiving stations further include a plurality of drive rollers which engage said inverted bottles at a neck portion thereof to support and rotate said bottles between the bottle infeed means and the bottle outfeed means.

26. A high speed bottle washing machine as claimed in claim 25, wherein one of said drive rollers is mounted on a pivoted support to pivot between an open loading position and a closed drive position.

27. A high speed bottle washing machine as claimed in claim 26, wherein a second of said rollers is resiliently biased to said closed drive position to minimize any impact stress on said bottle neck portion.

28. A high speed bottle washing machine as claimed in claim 25, wherein said rollers are belt driven by an elastic belt which stretches as said pivoted support pivots from said closed position to said open position.

29. A high speed bottle washing machine as claimed in claim 1, wherein said bottle receiving stations further include a plurality of drive rollers which engage said inverted bottles at a neck portion thereof to support and rotate said bottles between the bottle infeed means and the bottle outfeed means.

30. A high speed bottle washing machine for sequentially washing plastic returnable bottles upon their return, prior to refilling, each said bottle having residual soiled locations on an internal surface thereof, said machine comprising:

(a) an endless loop bottle carrier having a plurality of bottle receiving stations mounted thereon, said carrier having a bottle loading position and a bottle discharge position, (b) a first positive drive means mounted on each of said bottle receiving stations for independently gripping and rotating inverted bottles received at said bottle loading position as they traverse said endless loop to said bottle discharge position, (c) a plurality of moving spray nozzles, with each bottle receiving station having at least one spray nozzle associated therewith which travels with said station from said loading position to said discharge position, (d) a second means for inserting each of said plurality of spray nozzles into an associated inverted bottle after said bottle is received at said bottle loading position, (e) third means for providing a caustic wash fluid under pressure to each of said plurality of spray nozzles, whereby said bottles are cleaned by impingement of said wash fluid at said residual soiled locations within said bottles as the bottles are rotated, whereby said bottle washing machine sequentially receives and discharges bottles at a high rate of speed while providing an extended wash cycle as said bottles travel said loop between said bottle loading position and said bottle discharge position.

31. A high speed bottle washing machine as claimed in claim 30, wherein said each bottle receiving station has said first means and a single spray nozzle mounted thereon for travel with a bottle.

32. A high speed bottle washing machine as claimed in claim 31, wherein said third means further includes a manifold means, said manifold means also having said second means mounted therein as a fluid driven piston.

33. A high speed bottle washing machine as claimed in claim 32, wherein said fluid driven piston reciprocates said spray nozzle from a retracted position below said bottle to an inserted position within said bottle in response to the fluid pressure of said caustic wash fluid.

34. A high speed bottle washing machine as claimed in claim 30, wherein said third means further includes a manifold means for supplying a plurality of fluids that are selectively and sequentially supplied to said spray nozzle.

35. A high speed bottle washing machine as claimed in claim 30, wherein said machine further comprises a control means for automatic operation.

36. A high speed bottle washing machine as claimed in claim 34, wherein said machine further includes a control means for automatic operation, said control means including cam means for selectively supplying said fluids to said spray nozzles, and electronic means for controlling the speed of movement of said moving stations and the fluid pressure of the wash solution supplied to said manifold means.

37. A high speed bottle washing machine as claimed in claim 32 or 34 or 35 or 36, wherein said endless loop further comprises a circular carousel, with said bottle receiving stations mounted around the perimeter of the carousel.

38. A high speed bottle washing machine as claimed in claim 37, where in said machine includes a first and a second carousel, each of which provides an endless loop for said stations and said bottles.

39. A high speed bottle washing machine as claimed in claim 37, wherein said machine further includes a bottle infeed starwheel at said bottle loading position, said starwheel having a plurality of bottle receiving pockets defined around a perimeter thereof.

40. A high speed bottle washing machine as claimed in claim 30, wherein said endless loop further comprises a circular carousel, with said bottle receiving stations mounted around the perimeter of the carousel.

41. A high speed bottle washing machine as claimed in claim 30 or 32 or 34 or 35 or 40, wherein said spray nozzles include a plurality of orifices arranged in a predetermined staggered pattern to focus impinging jets of caustic wash solution against the interior of said bottles as they are rotated to physically remove and chemically dissolve any soils therein.

42. A high speed bottle washing machine as claimed in claim 41 wherein said predetermined spray pattern has at least three impinging jets which discharge from said nozzle at angles $\phi_i$ ranging from 6° to 16° relative to a vertical axis of said bottle to impinge the internal bottom surface of Said bottle when positioned at a predetermined distance Y from the bottom of said bottle, wherein $Y = \arctan \phi_i \cdot (X_i)$; wherein $X_i$ is a horizontal distance measured from the center of said bottom to a point where one of said jets impinges said internal bottom surface.

43. A high speed bottle washing machine as claimed in claim 36, in which said electronic control means is a programmable logic controller.

44. A high speed bottle washing machine as claimed in claim 43, wherein said machine includes means for recovering said wash fluid for continuous use, and said electronic control means includes means for adjusting the ph of said wash fluid.

45. A high speed bottle washing machine as claimed in claim 44, wherein said machine further includes means for adjusting the temperature and pressure of said wash fluid, and said temperature and pressure are automatically regulated by,said control means.

46. A high speed bottle washing machine as claimed in claim 34, wherein said spray nozzles include a plurality of orifices arranged in a predetermined staggered pattern to focus impinging jets of caustic wash solution against the interior of said bottles as they are rotated to physically remove and chemically dissolve any soils therein.

47. A high speed bottle washing machine as claimed in claim 46, wherein said predetermined pattern of orifices staggers the impingement of adjacent jets as the bottles are rotated to avoid interference between adjacent jets.

48. A high speed bottle washing machine as claimed in claim 47, wherein said orifices have a length to diameter ratio greater than 20 to 1 to provide focused jets of fluid.

49. A high speed bottle washing machine as claimed in claim 48, wherein said orifices have a diameter of 0.4 to 0.8 mm.

50. A high speed bottle washing machine as claimed in claim 47, wherein said predetermined pattern provides jets of wash solution that mechanically peel any soils within said bottle while simultaneously chemically dissolving the same.

51. A high speed bottle washing machine as claimed in claim 34, said manifold means further comprising a plurality of valves for sequentially supplying at least said caustic wash fluid, and a second fluid to said spray nozzles.

52. A high speed bottle washing machine as claimed in claim 51, wherein said manifold further sequentially supplies a third fluid, with said second fluid being a acid neutralizing fluid.

53. A high speed bottle washing machine as claimed in claim 51, wherein said machine further includes a plurality of cams which engage said valves as said stations are moved from the bottle loading position to the bottle discharge position.

54. A high speed bottle washing machine as claimed in claim 32 or 34 or 35 or 40 or 46, wherein said first means further includes a plurality of drive rollers which engage said inverted bottles at a neck portion thereof to support and rotate said bottles between the bottle infeed means and the bottle outfeed means.

55. A high speed bottle washing machine as claimed in claim 54, wherein one of said drive rollers is mounted on a pivoted support to pivot between an open loading position and a closed drive position.

56. A high speed bottle washing machine as claimed in claim 55, wherein said rollers are belt driven by an elastic belt which stretches as said pivoted support pivots from said closed position to said open position.

57. A high speed bottle washing machine as claimed in claim 56, wherein a second of said rollers is resiliently biased to said closed drive position to minimize any impact stress on said bottle neck portion.

58. A high speed bottle washing machine as claimed in claim 30, wherein said bottle receiving stations further include a plurality of drive rollers which engage said inverted bottles at a neck portion thereof to support and rotate said bottles between the bottle loading position and the bottle discharge position.

* * * * *

UNITED STATES PATENT AND TRADEMARK OFFICE

CERTIFICATE OF CORRECTION

PATENT NO. : 5,441,063

DATED : August 15, 1995

INVENTOR(S) : Antonio Ferandez

It is certified that error appears in the above-indentified patent and that said Letters Patent is hereby corrected as shown below:

Column 1, line 30: delete second occurrence of --No.--

Column 16, line 13: "Seat" should read --seat--

Column 28, line 16; "20," should read --20.--

Signed and Sealed this

Seventeenth Day of March, 1998

*Attest:*

*Attesting Officer*

BRUCE LEHMAN

*Commissioner of Patents and Trademarks*